US010738971B2

(12) United States Patent
Van Winkle et al.

(10) Patent No.: US 10,738,971 B2
(45) Date of Patent: Aug. 11, 2020

(54) ADJUSTABLE UNDER CABINET LIGHT

(71) Applicant: ETi Solid State Lighting Inc., Wheeling, IL (US)

(72) Inventors: Gary Van Winkle, Chagrin Falls, OH (US); William Carter, Brooks, GA (US); Kerby Siglin, Kennesaw, GA (US)

(73) Assignee: ETi Solid State Lighting Inc., Wheeling, IL (US)

( * ) Notice: Subject to any disclaimer, the term of this patent is extended or adjusted under 35 U.S.C. 154(b) by 0 days.

(21) Appl. No.: 16/451,599

(22) Filed: Jun. 25, 2019

(65) Prior Publication Data

US 2020/0003397 A1 Jan. 2, 2020

Related U.S. Application Data

(60) Provisional application No. 62/691,175, filed on Jun. 28, 2018.

(51) Int. Cl.

| | |
|---|---|
| ***F21V 14/00*** | (2018.01) |
| ***F21V 21/096*** | (2006.01) |
| ***F21V 17/02*** | (2006.01) |
| ***F21S 8/00*** | (2006.01) |
| ***F21V 15/015*** | (2006.01) |
| ***F21Y 103/10*** | (2016.01) |
| ***F21V 23/00*** | (2015.01) |
| ***F21Y 115/10*** | (2016.01) |

(52) U.S. Cl.

CPC ..... *F21V 14/006* (2013.01); *F21S 8/03* (2013.01); *F21V 15/015* (2013.01); *F21V 17/02* (2013.01); *F21V 21/096* (2013.01); *F21V 23/001* (2013.01); *F21Y 2103/10* (2016.08); *F21Y 2115/10* (2016.08)

(58) Field of Classification Search

CPC ..... F21S 8/03; F21S 8/031; F21V 21/096; F21V 21/0965

See application file for complete search history.

(56) References Cited

U.S. PATENT DOCUMENTS

| | | | | |
|---|---|---|---|---|
| 4,617,612 A * | 10/1986 | Pritchett | ..... | F21S 6/003 362/216 |
| 5,205,632 A * | 4/1993 | Crinion | ..... | F21S 8/00 362/223 |
| 2009/0097238 A1* | 4/2009 | Cousaine | ..... | F21S 9/02 362/191 |
| 2009/0279298 A1* | 11/2009 | Mier-Langner | ..... | F21V 21/096 362/235 |

(Continued)

FOREIGN PATENT DOCUMENTS

| | | | | |
|---|---|---|---|---|
| DE | 202010008645 U1 * | 2/2011 | ..... | A01K 63/06 |

*Primary Examiner* — Alexander K Garlen

(74) *Attorney, Agent, or Firm* — Walter | Haverfield LLP; D. Peter Hochberg; Sean F. Mellino

(57) ABSTRACT

An adjustable under cabinet LED light fixture having a tube holding LEDs that can be rotated to different amounts to direct illumination in a particular direction. The LED light fixture can be moved relative to a mounted plate attached to the bottom of a cabinet or the ceiling of a compartment below a sink or the like in a horizontal direction, and held to the mounted plate by magnetic attraction. The LED light fixture can also be dimmable to vary the color temperature of the LED illumination.

8 Claims, 21 Drawing Sheets

(56) References Cited

U.S. PATENT DOCUMENTS

| | | | | |
|---|---|---|---|---|
| 2010/0135020 | A1* | 6/2010 | Moore | A47F 11/10 362/249.02 |
| 2011/0062897 | A1* | 3/2011 | Li | F21V 21/043 315/362 |
| 2011/0286208 | A1* | 11/2011 | Chen | F21V 21/30 362/217.1 |
| 2012/0068621 | A1* | 3/2012 | Ward | F21V 21/096 315/294 |
| 2015/0226384 | A1* | 8/2015 | Park | F21S 2/00 362/223 |
| 2015/0311689 | A1* | 10/2015 | Noh | H02G 3/305 362/147 |
| 2016/0195250 | A1* | 7/2016 | Park | F21S 8/038 362/219 |
| 2018/0031217 | A1* | 2/2018 | Tuchler | F21V 21/04 |

* cited by examiner

ADJUSTABLE UNDER CABINET LIGHT

CROSS-REFERENCE TO RELATED APPLICATION

This application claims priority of U.S. Provisional Application No. 62/691,175 filed Jun. 28, 2018, which is incorporated herein by reference in its entirety.

BACKGROUND OF THE INVENTION

Field of the Invention

The present invention relates to LED lighting, and more particularly to an under cabinet LED light, and even more particularly to adjustable LED under cabinet light.

Description of the Prior Art

Under cabinet lighting is well known in the art. Such lights, for example, are used beneath kitchen cabinets which extend from a wall and have an under-space which is spaced from a counter beneath a cabinet attached to the wall. Under cabinet lighting can be used in the foregoing under-space to illuminate the counter partly or entirely beneath the wall cabinet. Such lights include strip lights, light bars, rope lights, puck lights, LED puck lights, tape lights, hardwired and plug-in light bars, and hardwired puck lights. Also used are fluorescent lights with brackets for holding the fluorescent lights beneath the wall cabinets for illuminating the counter below the cabinet.

Typical fluorescent lights and LED lights are generally mounted beneath the cabinets attached to a vertical wall and are turned on and off by individual light switches. Such presently available lights have a constant level of illumination and their control is an on-off switch. Puck lights are usually positioned to focus their illumination straight down beneath the puck lights or can be directed toward a backsplash. Light strips come in different lengths, and generally have a length equal to the length of the off-the-wall cabinet. Tape lights include small LEDs that are embedded in tape strips that are flexible and have removable backing with an adhesive therebeneath to enable the strip lights to be taped to the bottom of the off-the-wall cabinet. Rope lights are generally larger than tape lights. They include LED light strips located in plastic tubing that are installed under the off-the-wall cabinets or along toe kicks. Rope lights typically have a particular light output and a particular color temperature. Bar lights include a housing in which a source of illumination such as a fluorescent light tube or an LED light tube is incorporated. A light bar is typically mounted on the underside of an off-the-wall cabinet. Such light bars have a fixed level of illumination. Light bars, just as some of the other known under cabinet lights available in the art, have models which are battery-operated. Light bars are also on the market having xenon lights.

Under cabinet lighting also includes lighting with a dimming capability. Dimmers give the user control over the magnitude of lighting, which can assist in energy-saving and also adjust light intensity to be more comfortable to a person's eyes. Low-intensity also reduces glare.

LED lights also have the advantage of energy efficiency. LED lights do not generate significant amounts of heat, to render LED lights easy to touch and which generally do not affect foods or food ingredients that are sensitive to light.

LED and florescent lights are less hot than other known lightings including incandescent lights, xenon lights and halogen lights.

Another form of dimmable lights is dimmable color tuning. Color temperature is important since it relates to "atmosphere." Color temperature is a characteristic of visible light. Color temperatures vary from cool colors, which are bluish white, and occur when the color temperature is over 5000K, to warm and hot colors. Lower color temperatures, those between 2700K-3000K, are known as warm colors and are yellowish white through red. Warm colors relate to traditional incandescent lighting rather than the temperature of the illumination. Thus, warm lights relating to color temperature, relate not to its temperature but to its visible color. Under cabinet lights with adjustable color temperatures have not heretofore been known.

Under cabinet LED lights are conventionally fixedly mounted on an overhanging upper wall such as in a cabinet beneath the sink or work area or beneath an overhanging on-the-wall cabinet. In these situations, illumination is occasionally sought for areas inside of the cabinet or beneath the overhanging cabinet where the fixedly mounted light does not shine sufficient illumination. In these systems, either the user may have to go up around the space of interest with the user's hands to find what is being sought, or possibly use a flashlight to examine the space. It would be of great advantage to be able to move the under cabinet light to shine illumination in the area being investigated.

One possible solution is to provide a mounting bar which is attached to the downwardly facing wall, the bar having rows of holes for receiving screws or other mechanical devices to movably secure the light to the mounting bar. Such an arrangement would be time consuming to use, and would be awkward to actually implement, particularly in tight spaces where the user would have limited access to the light on the mounting bar while using a screwdriver or the like to move the light to an appropriate position.

Another problem with moving an LED light with different specific arrangements would require that the light to be moved by fixed, discrete distances, such as where the screw holes are separated from each other by specific distances. There would be oftentimes a particular location for a light which would provide the illumination necessary, but at the present time there is no light mounting device available to make such a lighting arrangement possible. Moreover, there would in many instances be many optimum locations for a light to be located to provide the necessary illumination, and these locations would differ from time to time. Again, there is nothing available to accomplish this need.

Another shortcoming of the prior art is that the angle of illumination of under cabinet lights is fixed. Since conventional under cabinet lights direct illumination in a straight-down location where the under cabinet light is mounted on the underside of a horizontal bottom wall of an off-the-wall cabinet or the upper wall of a cabinet beneath a work area such as a sink, a fixed work area such as a space for working on a fixed piece of furniture in a kitchen, workshop, storage location or the like. Present under cabinet lights direct their location in the downward position which may not provide the desired illumination. As explained previously, the shortcomings would require the user to either go around with the user's hands to locate what is being sought or to use a flashlight which would be time consuming and aggravating to accomplish the desired purpose. It would be of significant advantage to have an LED light with directional illumination whose direction could be varied by means of easily changing the angle of illumination of the light in an under cabinet LED light.

Not only do each of the foregoing problems provide significant shortcomings of presently known under cabinet LED lights, but even under cabinet LED lights for accomplishing one of the foregoing shortcomings would not satisfy each of the latter shortcomings. It would be a significant advancement in the art of under cabinet LED lighting to provide an under cabinet LED light which would be movable either along the overhang of a wall mounted cabinet, the downwardly facing wall of a wall-mounted cabinet, or the upper horizontal wall of an under cabinet of a work station such as sink or other horizontal working area. Although the term horizontal is being used herein, this would also include some amounts of canting of the overhanging upper surface of a wall mounted cabinet, the upper surface of a sink portion in the kitchen or the space beneath an upper work area of a work table or work cabinet or the like.

BRIEF SUMMARY OF THE INVENTION

It is an object of the present invention to provide an under cabinet LED light fixture which can be easily moved to focus illumination on a particular space in which illumination is sought.

Another object of the present invention is to provide a movable under cabinet LED light fixture where the light can be moved manually without any tools required.

It is a further object of the invention to provide a movable under cabinet LED light whose direction of illumination can be changed by manually moving the LED light either crosswise or lengthwise relative to the horizontal area on which it is located or at any desired horizontal angle from the upper surface in which the under cabinet LED light is located.

It is still an additional object to provide an adjustable under cabinet LED light which can be moved to change the direction of illumination without any necessary tools or other changing implements, relying solely on the hands of the user of the adjustable LED light.

It is a further object of the present invention to provide an under cabinet LED light assembly whose angle of illumination can be varied.

A still further object of the present invention is to provide an under cabinet LED light assembly where the angle of illumination can be changed without requiring a visual observation of the light whose angle of illumination is to be changed.

An additional object of the present invention is to provide an under cabinet LED light assembly which can be fabricated using known, economical and efficient materials and components using conventional methods of manufacture.

It is a further object of the present invention to provide an under cabinet LED light assembly where the color temperature can be easily varied.

It is yet a still further object of the present invention to provide an under cabinet LED light assembly which is movable in horizontal directions to change the space for receiving a maximum illumination from the illumination from the LED light assembly, provide a further change in the angle of illumination from the LED light in the light assembly, and vary the color temperature of the illumination coming from the light in the light assembly.

Another object of the present invention is to provide an LED light assembly as described above which can be produced economically and efficiently, and be sold at a reasonable price to consumers. These and other objects will be apparent from the description to follow and from the appended claims.

DETAILED DESCRIPTION OF THE PREFERRED EMBODIMENTS

Figures 3A, 3B, 3C:
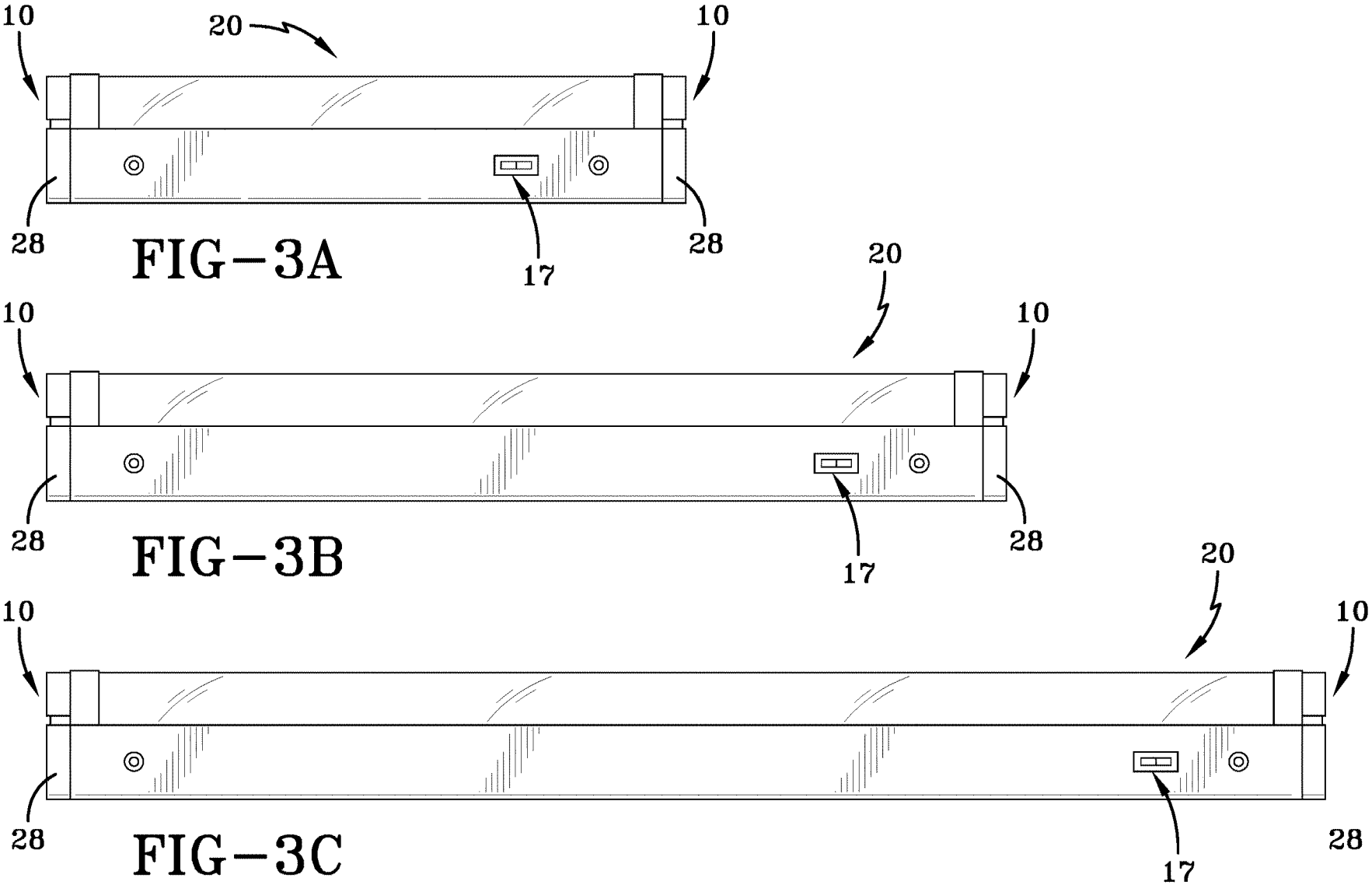
FIGS. 3A, 3B and 3C are side views of the adjustable under cabinet light assembly shown in FIGS. 1A-1C, and 2A-2C.
Figure 4:
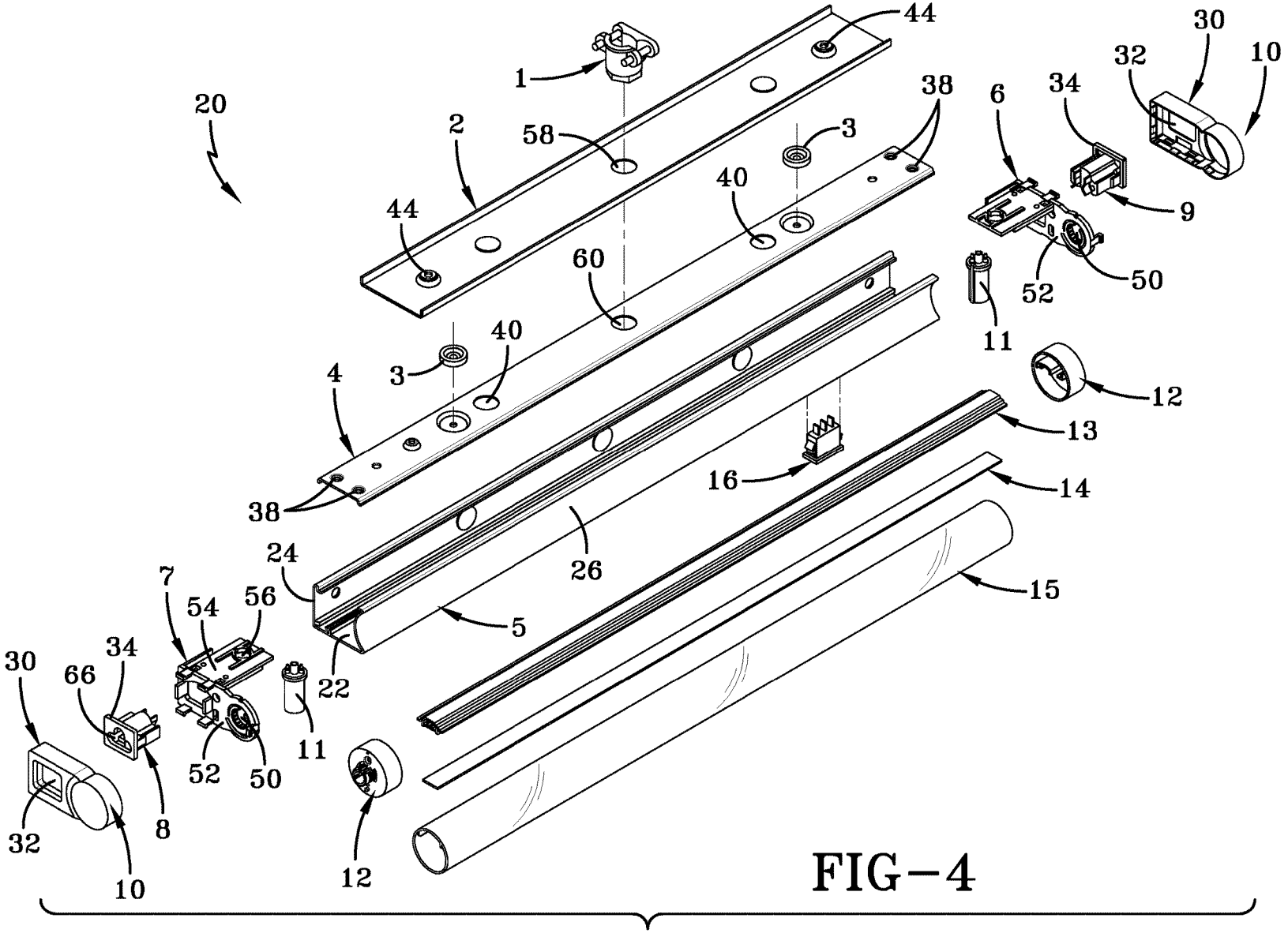
FIG. 4 is an exploded view of the adjustable under cabinet LED light fixture according to the preferred embodiment of the invention.
Figure 5B:
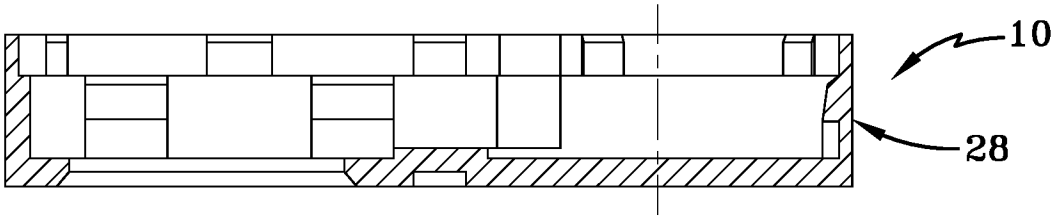
FIGS. 5A, 5B, 5C, 5D, 5E and 5F are respectively a side view, a front view, an end view, the opposite end view, and a pair of perspective views of the side cover incorporated in the preferred embodiment of the invention.
Figure 5C:
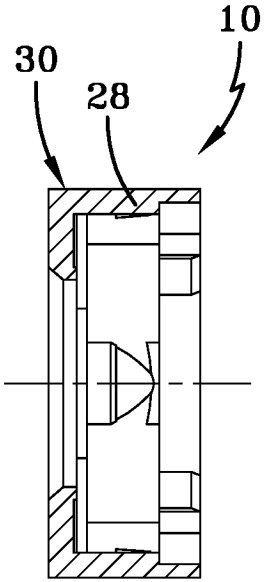
Figure 5D:
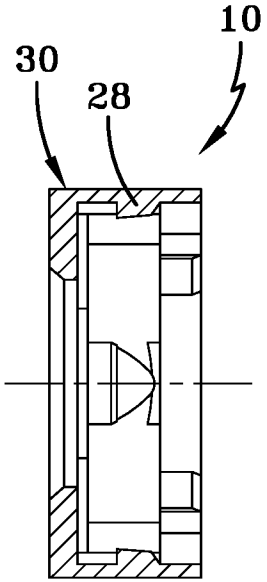
Figure 5A:
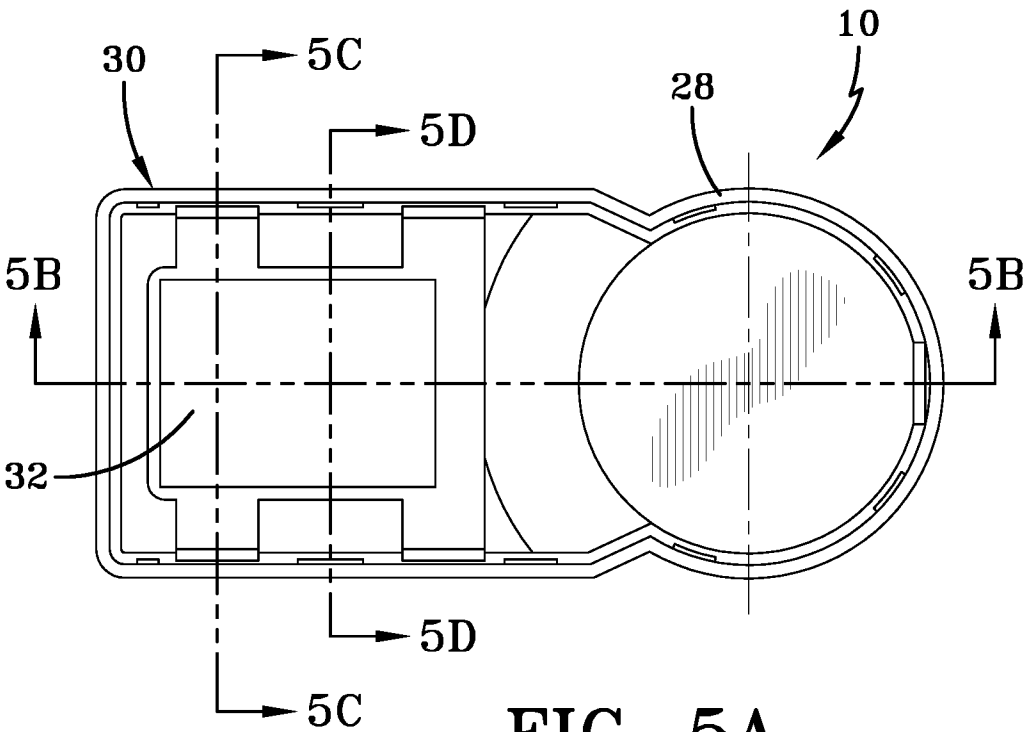
Figure 5E:
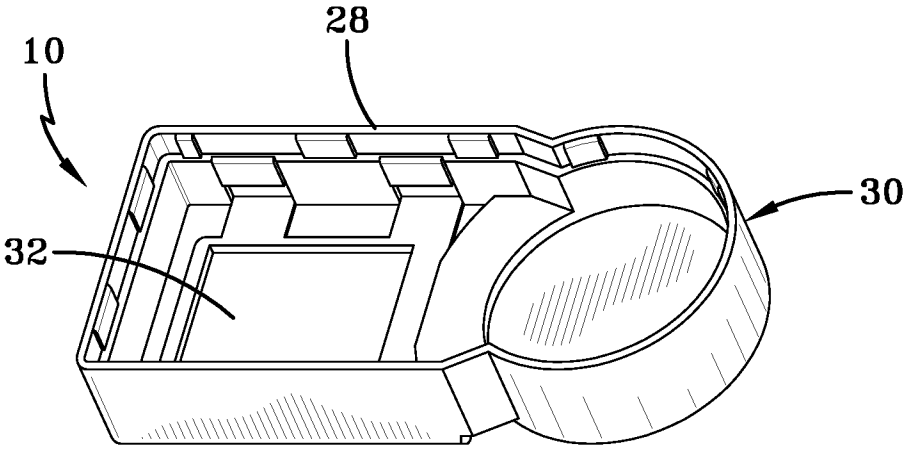
Figure 5F:
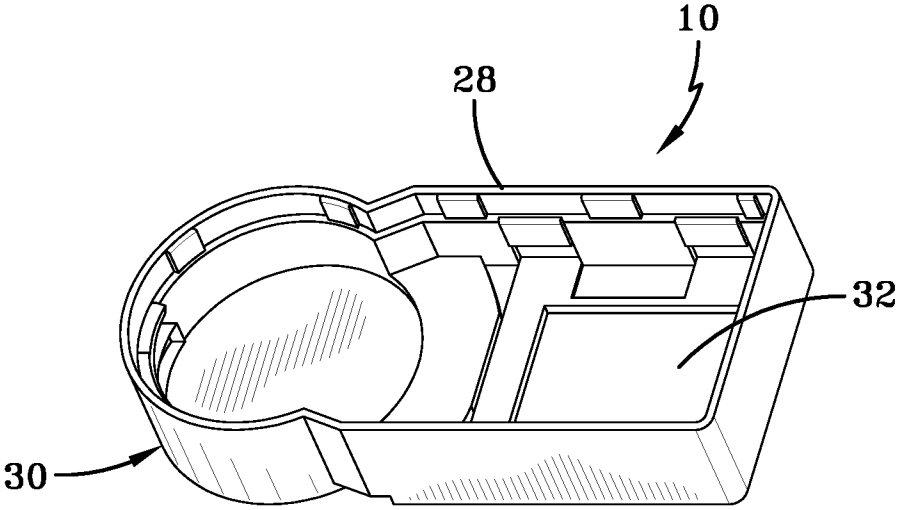
Figure 6B:
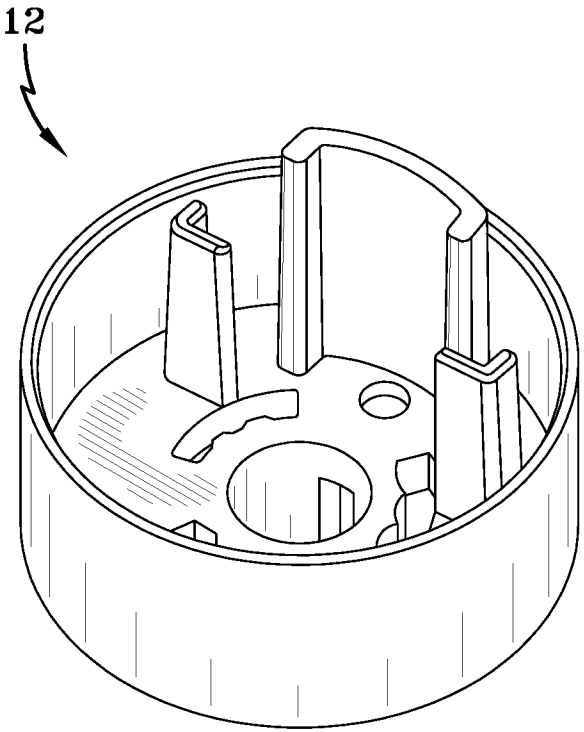
FIGS. 6A, 6B, 6C, 6D and 6E are respectively a perspective front view, a perspective interior view, an end view, a side view and another side view of an end cover incorporated in the preferred embodiment of the invention.
Figure 6A:
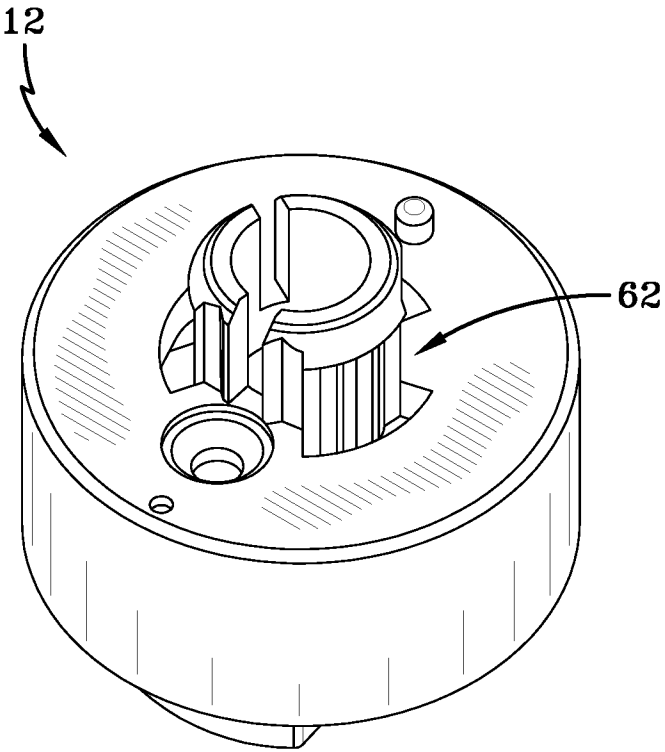
Figure 6D:
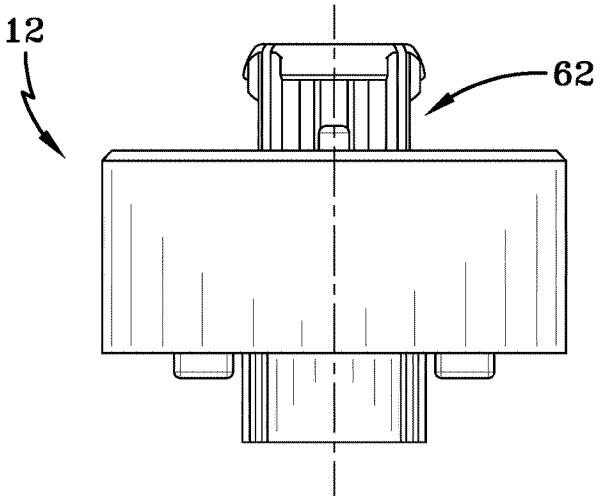
Figure 6E:
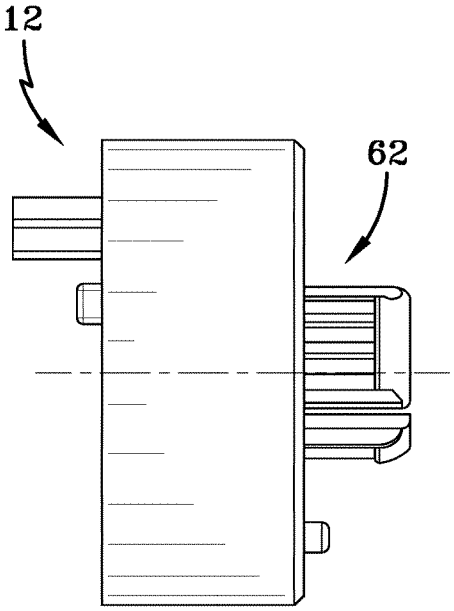
Figure 6C:
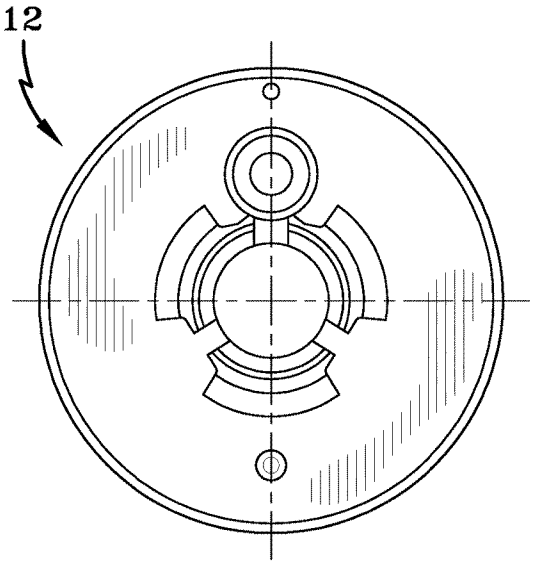
Figure 7B:
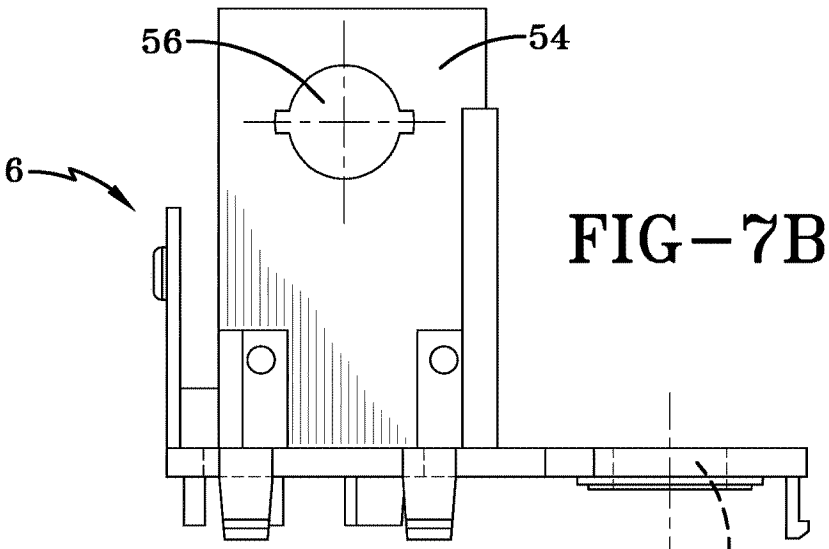
FIGS. 7A, 7B, 7C, 7D, 7E, 7F and 7G are respectively a front view, a side view, an end, a separate side view from that shown in FIG. 7B, an opposite end view from that shown in FIG. 7C, and a pair of perspective views of a right bracket incorporated in the preferred embodiment of the invention.
Figure 7A:
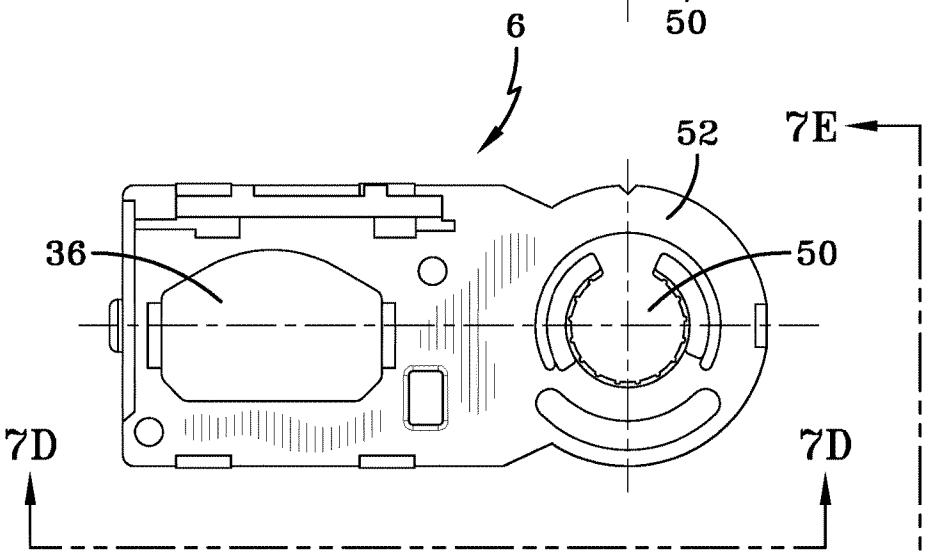
Figure 7C:
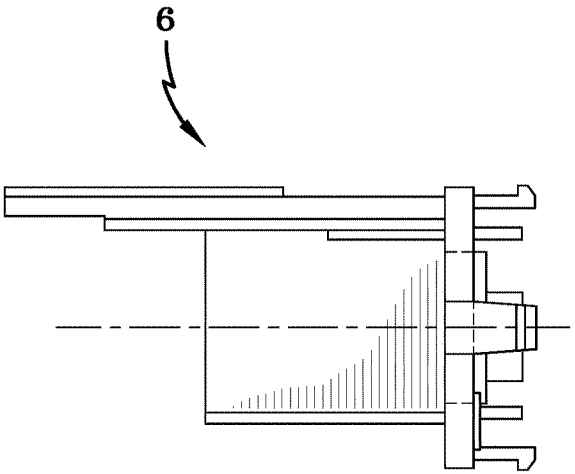
Figure 7E:
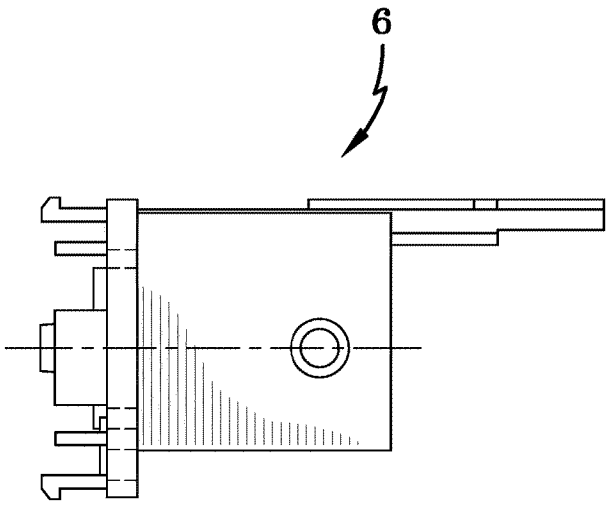
Figure 7D:
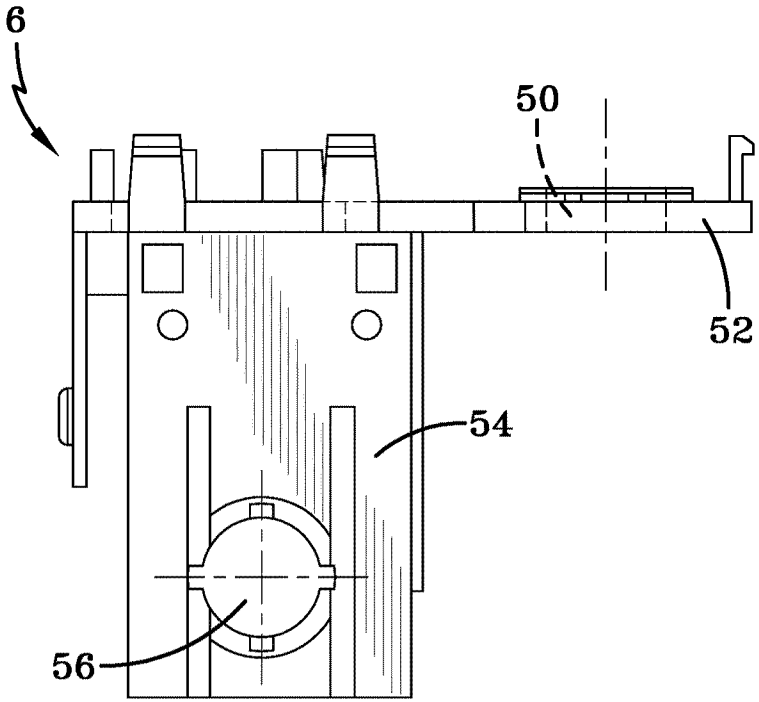
Figure 7G:
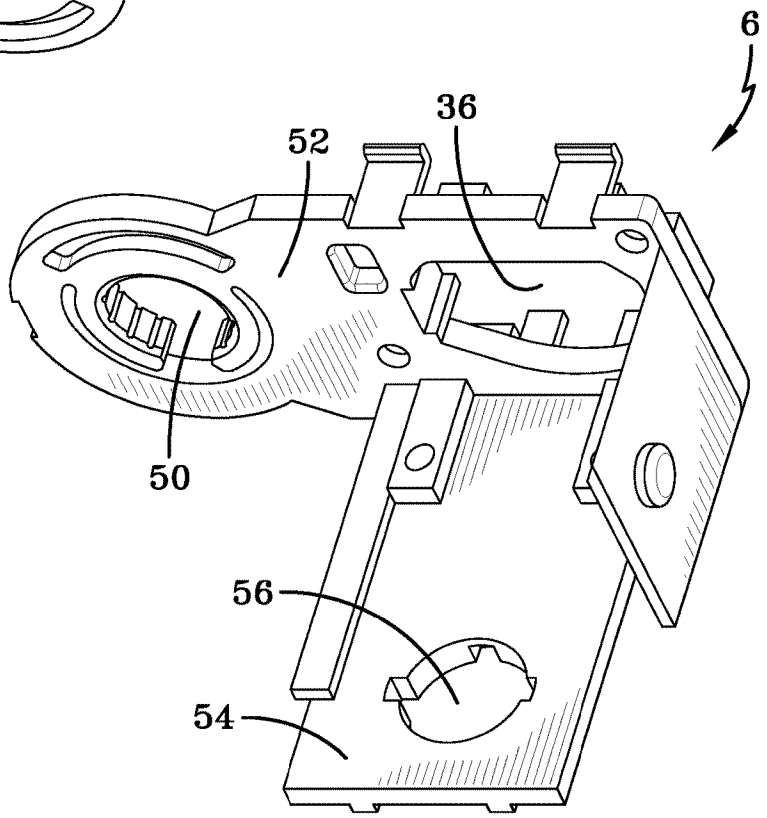
Figure 7F:
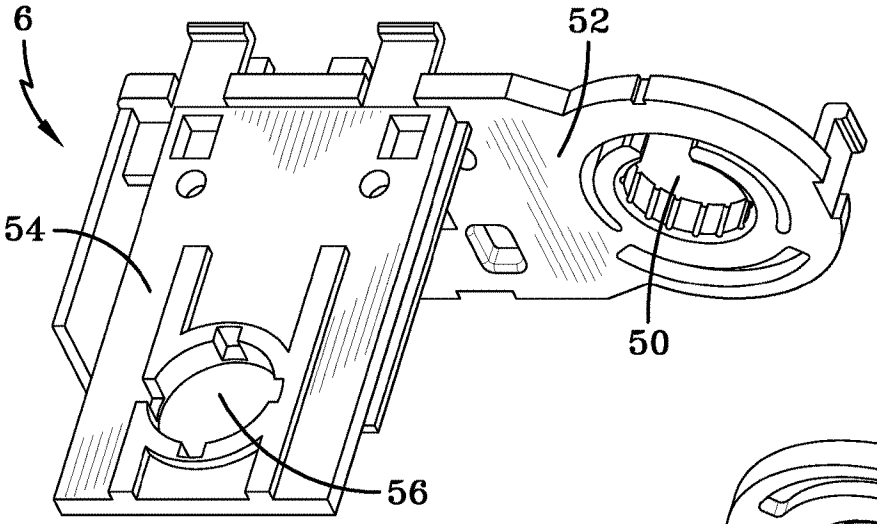
Figure 8A:
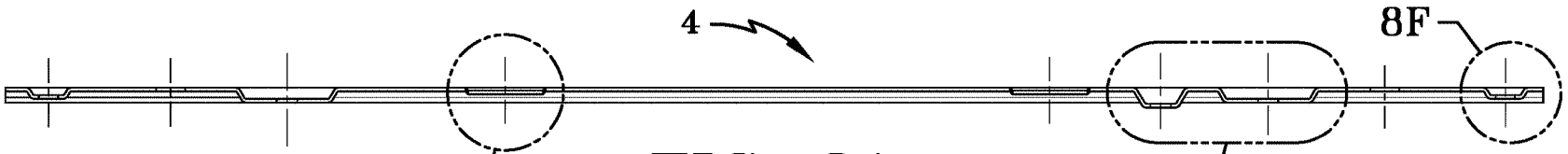
FIGS. 8A, 8B, 8C, 8D, 8E and 8F are side, top, end and three cross-sectional views of a backboard incorporated in the preferred embodiment of the adjustable under cabinet light fixture shown in the preceding figures.
Figure 8B:
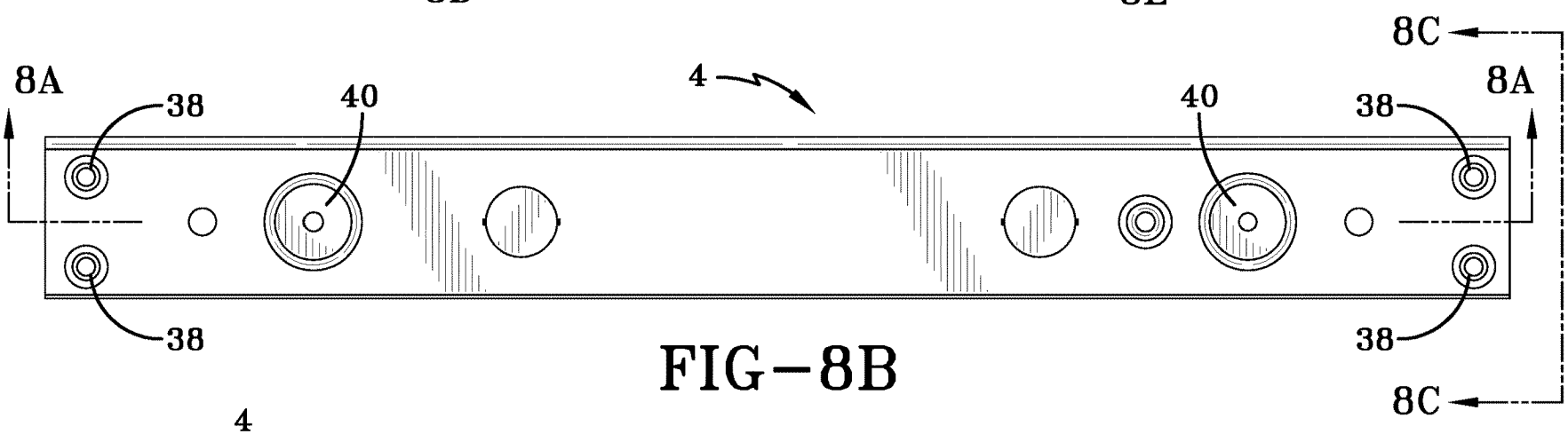
Figure 8F:
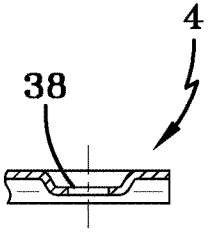
Figure 8E:
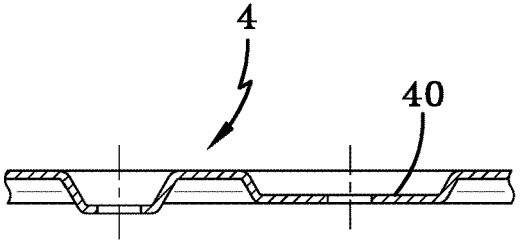
Figure 8D:
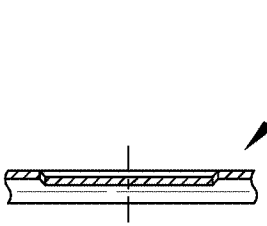
Figure 8C:
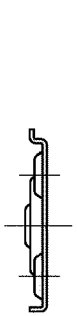

Referring to the drawings, FIGS. 1A, 1B, 1C, 2A, 2B and 2C are perspective views of an adjustable under cabinet LED light tube fixture 20 according to a preferred embodiment of the invention. FIGS. 3A, 3B and 3C illustrate three different sizes of under cabinet LED light tube fixture 20. Referring to FIG. 4, LED light tube fixture 20 includes a bracket 5. Bracket 5 is composed of a base 22 from which extend at 90° a first sidewall 24 from one edge of base 22 and a slightly inwardly curved second sidewall 26 from an opposite parallel edge of base 22. A pair of end covers 12 for covering the ends of a tube is described in detail below. Extending in a direction perpendicular to base 22 at its opposite ends are a pair of side covers 10 for bracket 5 (with necessary changes incorporated between the left and right versions).

Still referring to FIG. 4, an LED lamp is composed of an LED tube 15 preferably composed of an appropriate plastic. A printed circuit board 13 extends along the length and the inside of LED tube 15. An LED support 14 to which is attached printed circuit board 13 with an array with LEDs attached thereto, is also located on the inside of and extending along the length of LED tube 15. Printed circuit board 13 and LED support 14 are parallel to each other. Referring also to FIGS. 5A-5F, each side cover 10 has a round cup-like member 28 for receiving one of pair of end covers 12 shown in FIG. 4 and in detail in FIGS. 6A-6E. Each end cover 12 is disposed at opposite ends of plastic LED tube 15. Each of the pair of side covers 10 is composed of a cup-like member 28, and further comprises a plug access part 30 (FIGS. 4, 5A, 5E and 5F) having an orifice 32 dimensioned to receive power-in receptacle 8 or a right or power-out receptacle 9, respectively. Power-in receptacle 8 is disposed in a left bracket 7 (not to be confused with bracket 5). A right bracket 6 operates in the same manner as does left bracket 7. Referring to FIGS. 7A-7G, right bracket 6 is shown. Left bracket 7 is essentially the same as right bracket. Right bracket 6 includes an interior grooved cylinder 50 located in rearwardly extending (when installed in LED light fixture 20) from a generally flat extension 52 in which interior grooved cylinder 50 is located. With reference to FIGS. 7A-7G, and especially to FIGS. 7A and 7G, an orifice 36 is at the inner portion of right bracket 6 and left bracket 7, for receiving the inner end portions of respective power-in receptacle 8 and power-out receptacle 9 (when LED light fixture 20 is mounted for use, first sidewall 24 of bracket 5 is at the top of the mounted unit). Each bracket 6, 7 includes a generally flat section 54 that extends between first sidewall 24 and curved second sidewall 26 of bracket 5. Generally flat section 54 has an orifice 56 for receiving the end of one of a pair of position post 11 extending from base 22 of bracket 5.

With reference to FIGS. 4, 8A-8F and 9A-9B, LED light fixture 20 further has a backboard 4 having two pairs of screw holes 38 at its opposite ends for being attached to bracket 5. Backboard 4 is made of a ferrous material and has a pair of oppositely disposed recesses 40 which are dimensioned to receive magnets 3 which are able to magnetically be attracted to backboard 4. As illustrated in FIGS. 4, 10A-10E and 11A-11B, a ferrous mounting plate 2 has a pair of recessed mounting screw holes 44 for being screwed into the bottom of overhanging cabinets and to which backboard 4 that is attached to LED light tube fixture 20, is magnetically attracted. Backboard 4 is thus magnetically attracted to mounting plate 2, to hold LED light tube fixture 20 in place by its magnetic attraction to mounting plate 2. FIGS. 12A and 12B shows captive mounting screws 46 extending through mounting plate 2. A UL connector 1 illustrated in FIG. 4 is constructed for strain relief and is provided for connecting a flexible whip or NM cable of the power supply through the strain relief in the back plate or backboard 4 to LED under cabinet light tube fixture 20. Alternatively, the LED under cabinet light tube fixture 20 may be attached to the backboard 4 by non-magnetic means including, but not limited to, adhesives and/or Velcro.

Electric power must be provided for LED light tube fixture 20. That is the reason for the provision of UL connector 1 (FIG. 4). In order to attach UL connector 1 for operation, four captive screws (not shown) must be removed from screw holes 38 (FIGS. 4, 8B, 9A and 9B) in backboard 4, and an appropriate knockout hole 58 in mounted plate 2 and a corresponding knockout hole 60 in backboard 4 (FIG. 4) must be created through which UL connector 1 is inserted.

Figure 11A:
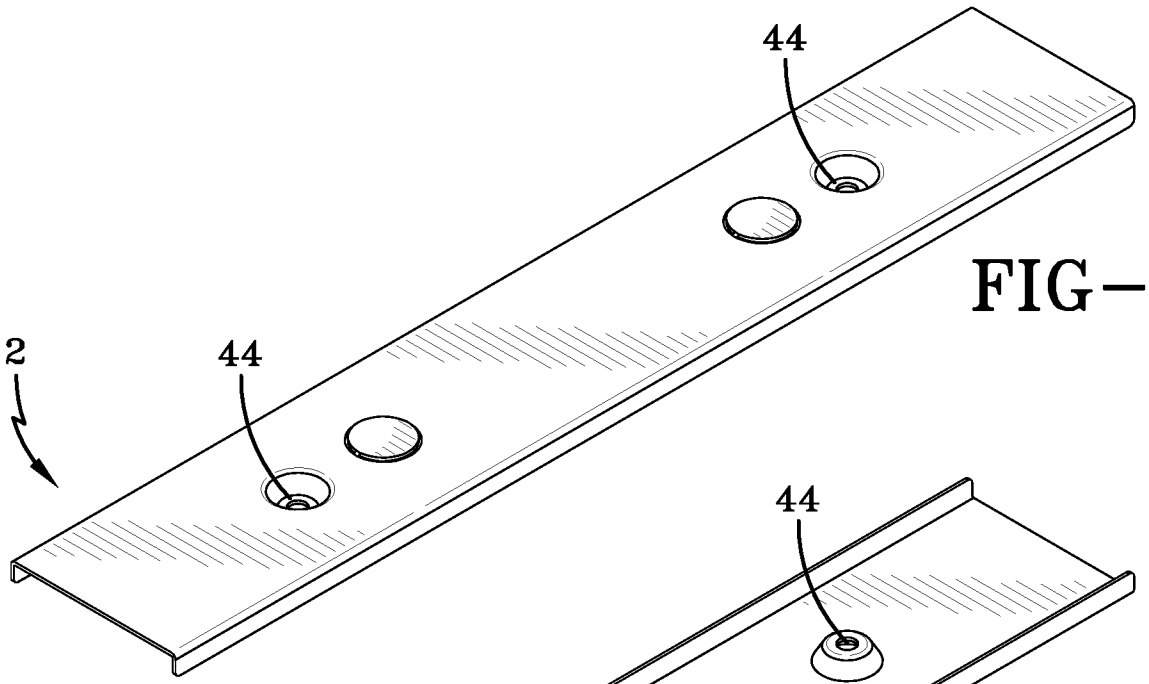
FIGS. 11A and 11B are top and bottom perspective views of the mounting plate shown in FIGS. 10A-10E.
Figure 11B:
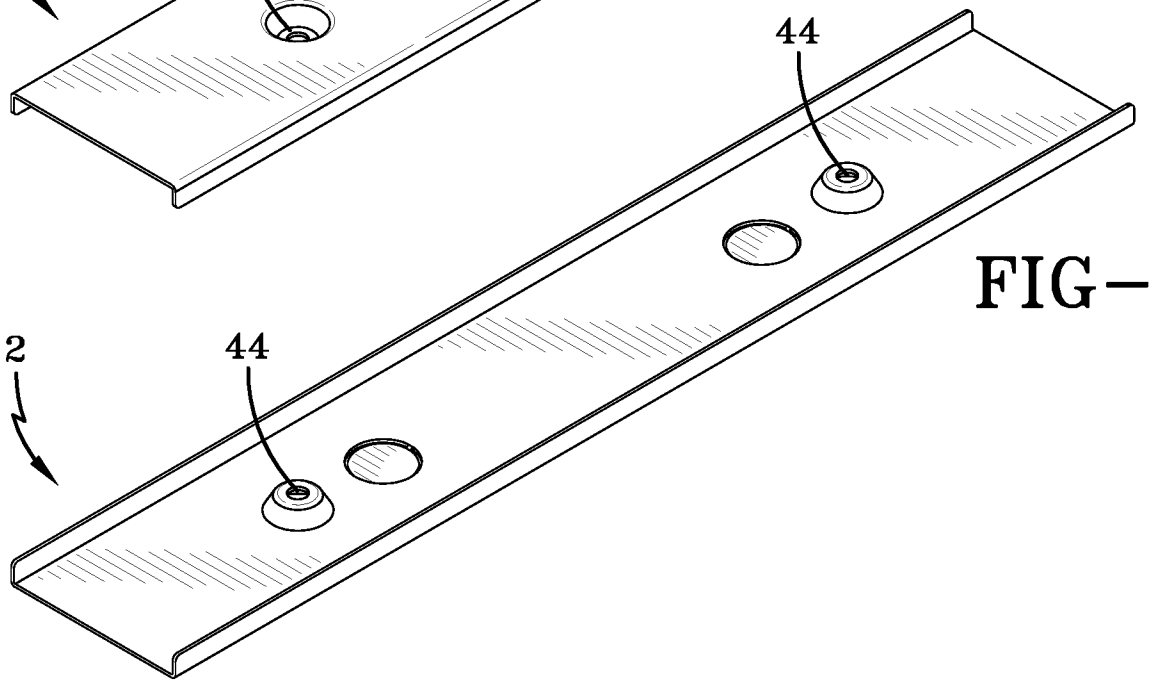
Figure 12A:
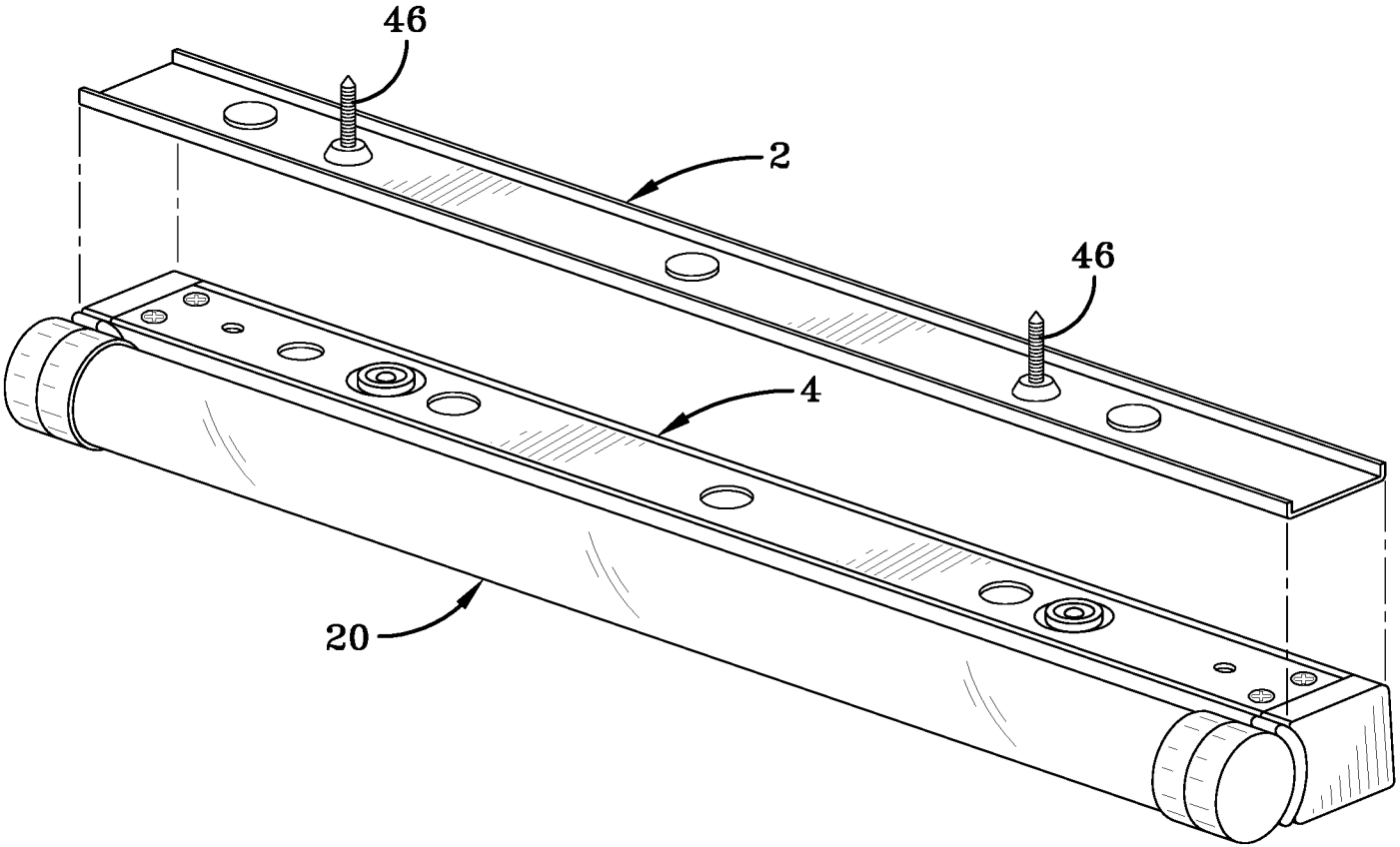
FIG. 12A is a perspective view of the adjustable under cabinet light assembly shown in the preceding figures with a mounted bar mounted with a pair of captive screws, shown separated from the remainder of the assembly.
Figure 12B:
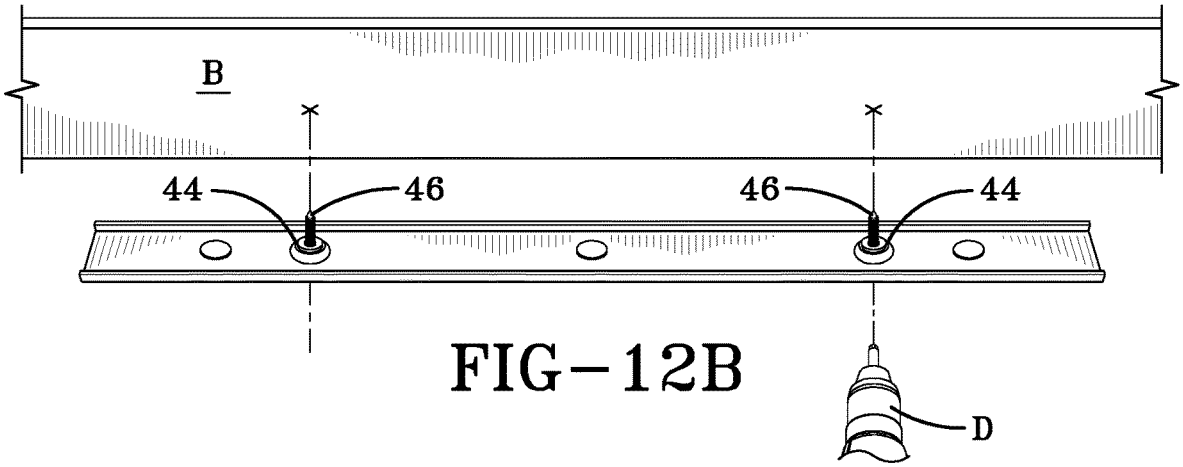
FIGS. 12B, 12C and 12D show in perspective the attachment of an adjustable under cabinet light assembly to a previously mounted mounting plate according to the preferred embodiment of the invention.
Figure 12C:
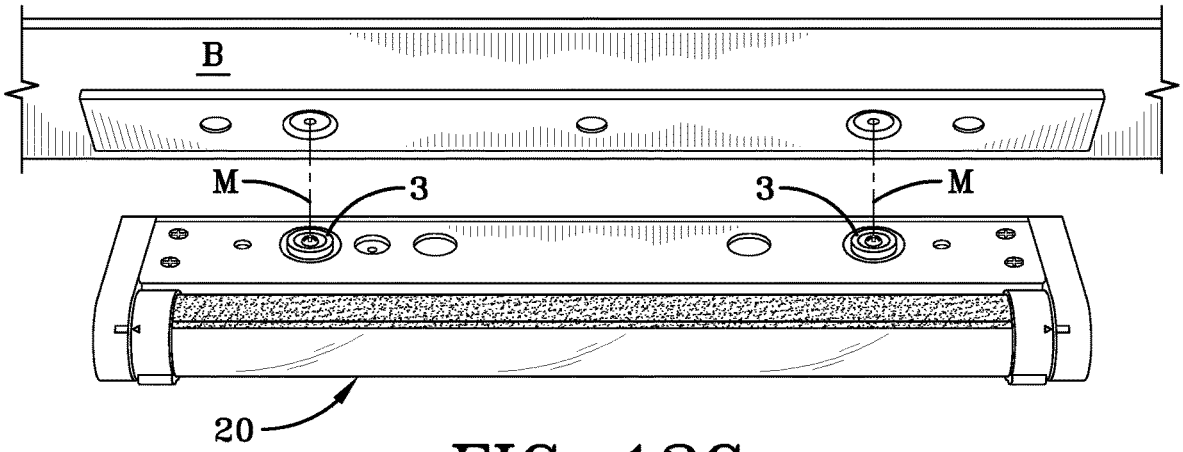
Figure 12D:
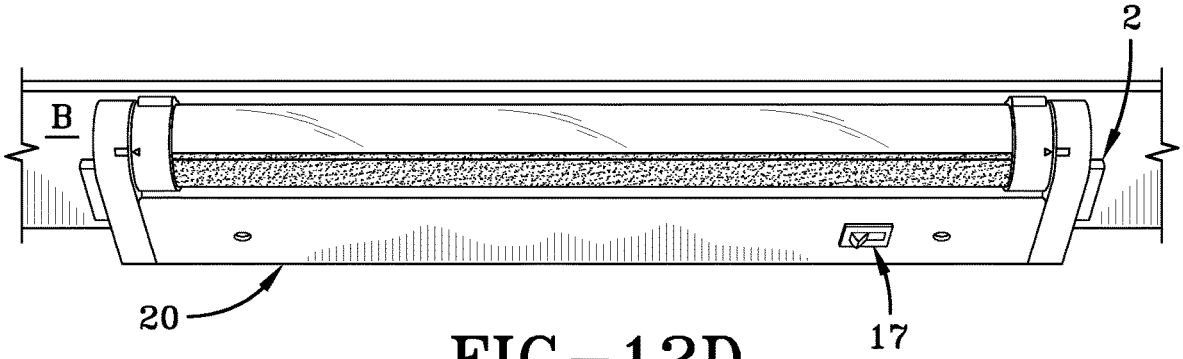

Part of the foregoing is shown in FIGS. 10A-10E, 11A-11B and FIGS. 12A-12D. In FIGS. 12A-12D captive screws 46 are inserted into the bottom of an over-hanging cabinet. LED light tube fixture 20 is then positioned anywhere beneath mounting plate 2 shown in FIGS. 12A-12D. This is because of the magnetic attraction between magnets 3 and mounting plate 2. The manner of attaching under cabinet light tube fixture 20 to a mounting plate 2 is shown in FIGS. 12B-12D. Initially, mounting plate 2 is attached by means of screws inserted through screw holes 44 to an underside board B by means of a drill D as indicated in FIG. 12B. Thereafter, with reference to FIG. 12C, under cabinet light tube fixture 20 is placed near mounting plate 2, and is magnetically attracted to ferrous mounting plate 2 by means of magnets 3. The magnetic lines of attraction are shown by dotted lines M. Finally, under cabinet light tube fixture is movably attached to the underside board B of the cabinet.

Figures 9A, 9B:
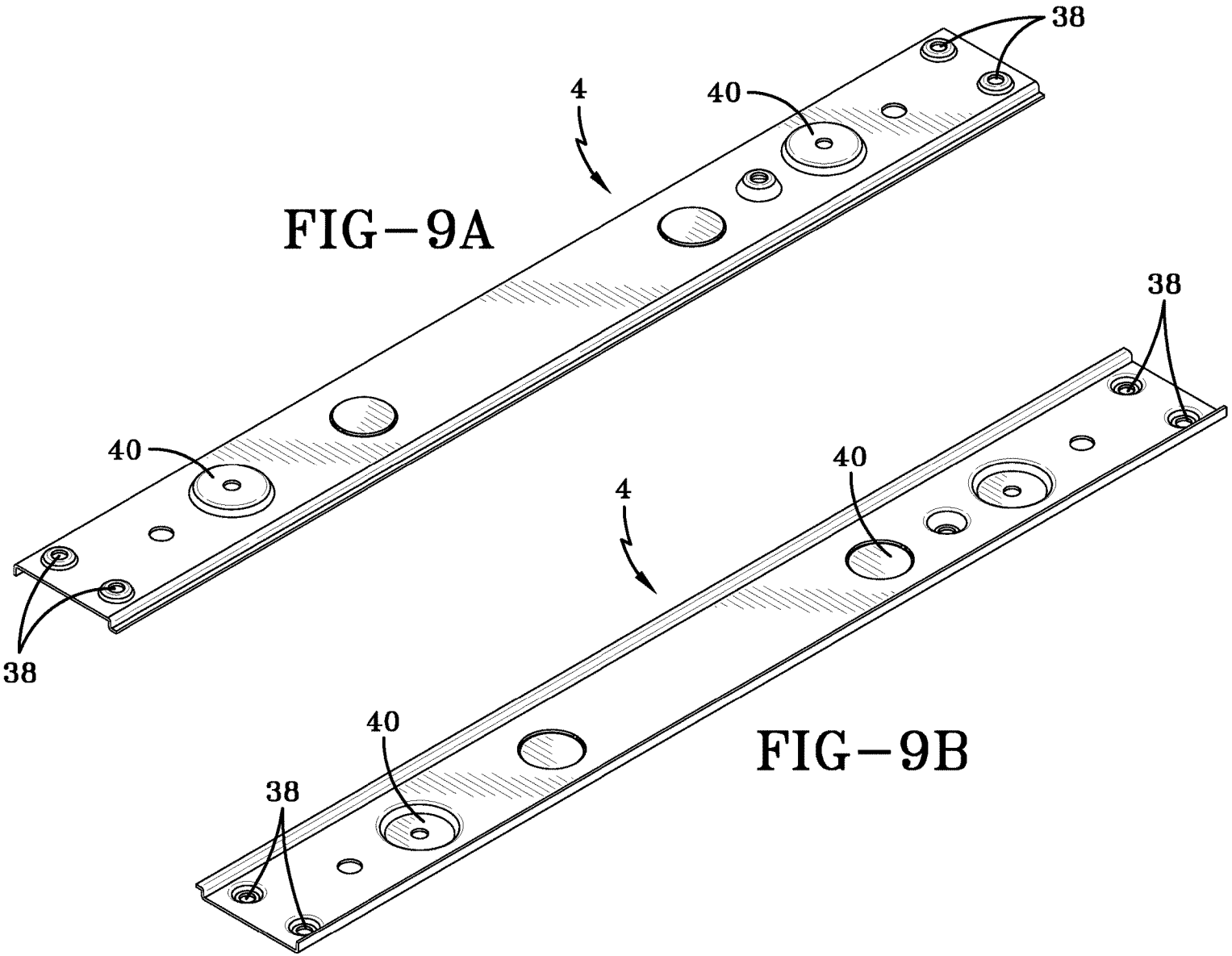
FIGS. 9A and 9B are top and bottom perspective views of the backboard shown in FIGS. 8A-8E.
Figure 10A:
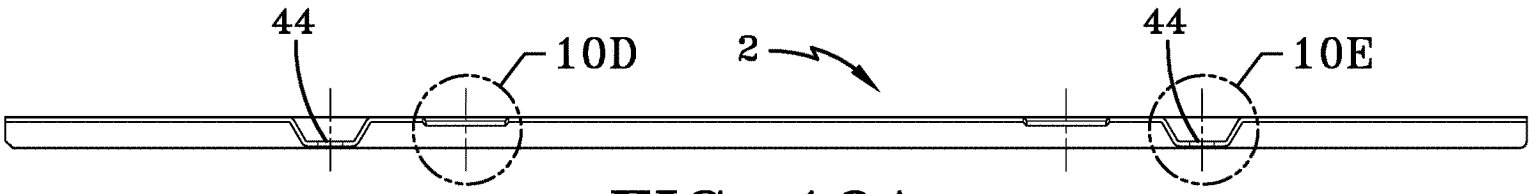
FIGS. 10A, 10B, 10C, 10D and 10E are respectively a side view, a top view, an end view, two cross-sectional views and an end view of a mounting plate incorporated in the preferred embodiment of the invention.
Figure 10B:
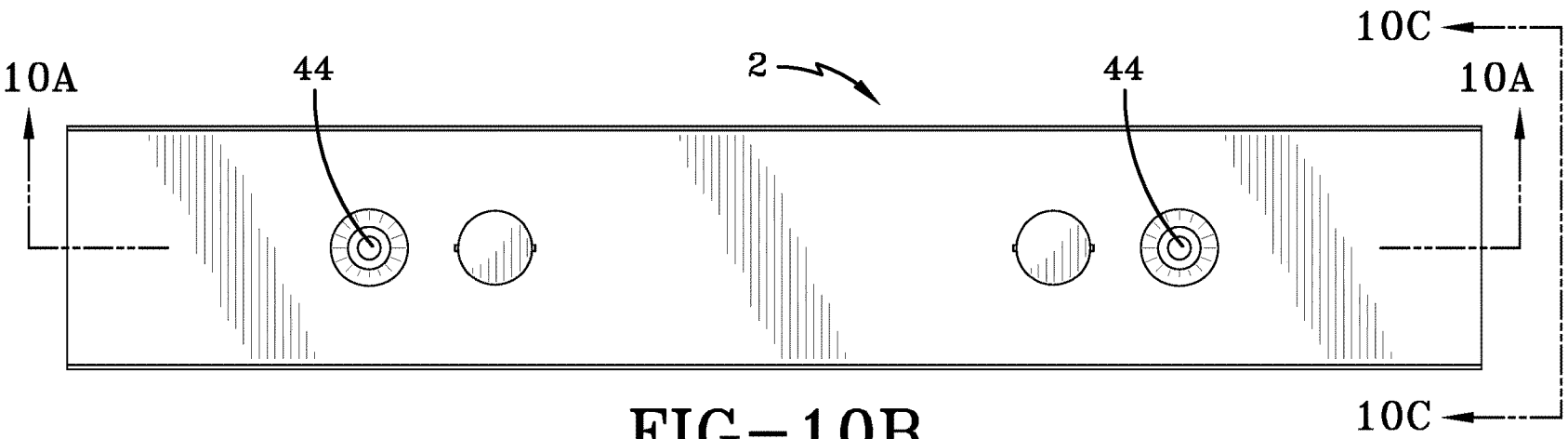
Figure 10E:
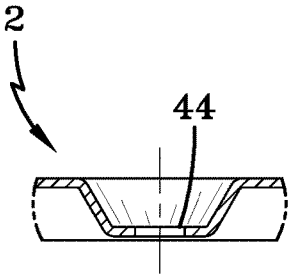
Figure 10D:
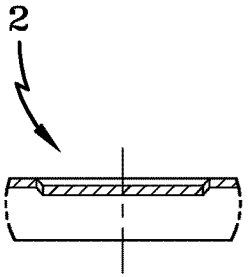
Figure 10C:
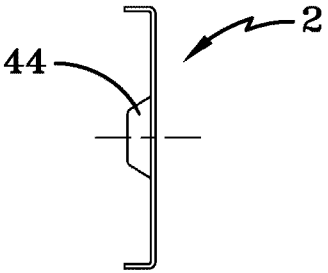

FIGS. 8A-8F, 9A and 9B show the details of backboard 4. Each of recesses 40 for holding magnets 3 and screw holes 38 are all shown. FIG. 4 shows knockout hole 60. FIGS. 9A and 9B are perspective views of backboard 4.

Referring next to FIGS. 10A-10E, these show in detail mounting plate 2 for a 12 inch size, and FIGS. 11A and 11B show mounting plate 2 in perspective form.

FIGS. 5A-5E show one of side covers 10. Side covers 10 are each composed of cup-like member 28 and orifice 32. Each cup-like member 28 receives one of covers 12 at the end of plastic LED tube 15. Orifice 32 on the left of fixture receives power-in receptacle 8, and the other orifice 32 on the right of fixture 20 in FIG. 4 receives power-out receptacle 9 in right side cover 10.

Figure 13:
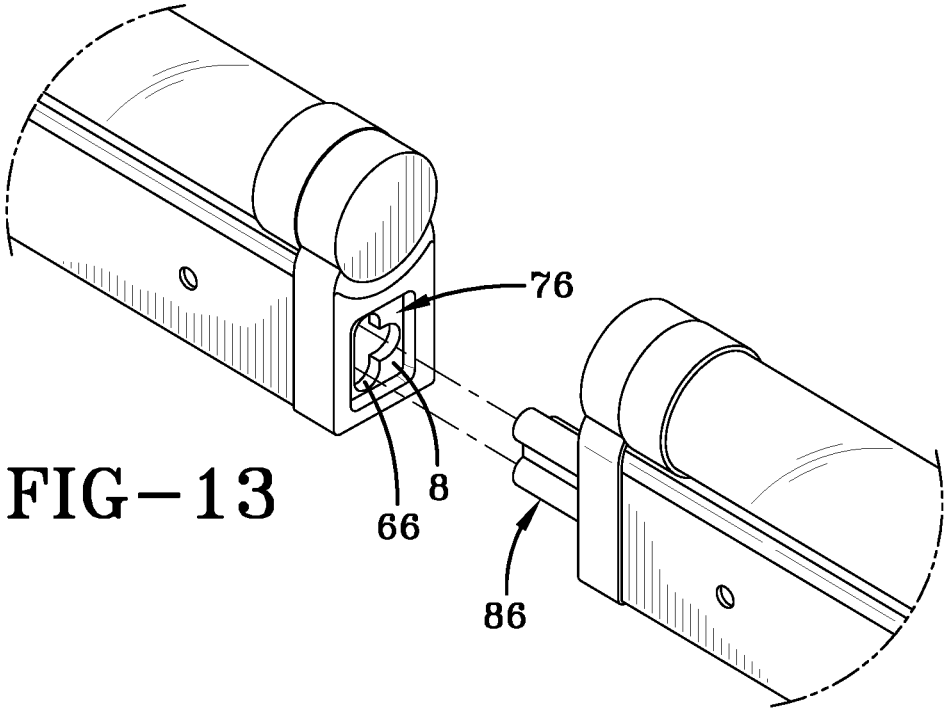
FIG. 13 shows a perspective illustration of a portion of a pair of adjustable under cabinet light fixtures according to a preferred embodiment of the invention about to be linked together by means of one type of linking device.

Referring back to FIGS. 4, 5A-5F and 6A-6E each cover 12 receives the end of plastic LED tube 15. Plastic LED tube 15 surrounds LEDs mounted on printed circuit board 13. Each cover 12 has an outwardly extending fluted hub 62. Left and right brackets 6 and 7 respectively receive power-in receptacle 8 and power-out receptacle 9. Each bracket 6 and 7 has interior grooved cylinder 50 for receiving fluted hub 62 with grooves that cooperate the flutes. Receptacles 8 and 9 are composed of three merged, parallel cylindrical tubes each having an inner outwardly extending electrically conducting tube for transmitting electrical power to (plug 8) or from (plug 9) LEDs mounted on a printed circuit board 13. Each of right bracket 6 and left bracket 7 further include flat extension 52 for extending beneath backboard 4. A trefoil shape end cover 64 (FIGS. 1A, 1B) fits over a linking cable receptor trefoil-shaped opening 66 (FIGS. 4, 13) for protection when receptacles 8 and 9 are not in use.

Figure 14:
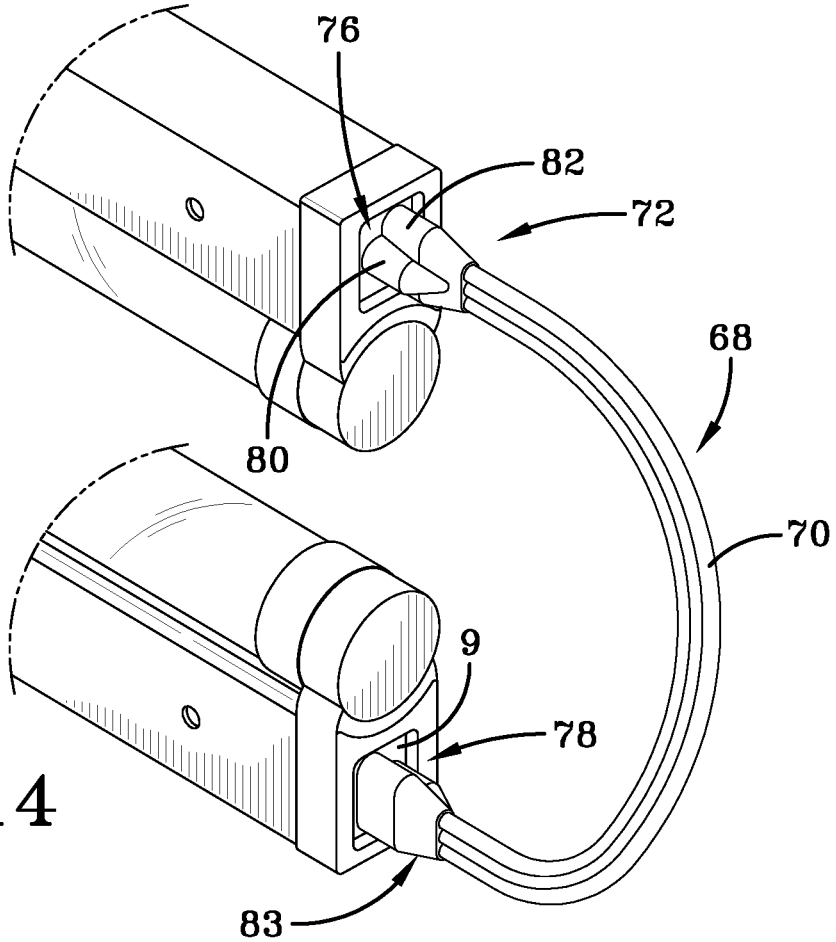
FIG. 14 shows a perspective illustration of a portion of a pair of adjustable under cabinet light fixtures linked together by another linking device pursuant to a preferred embodiment.
Figure 15A:
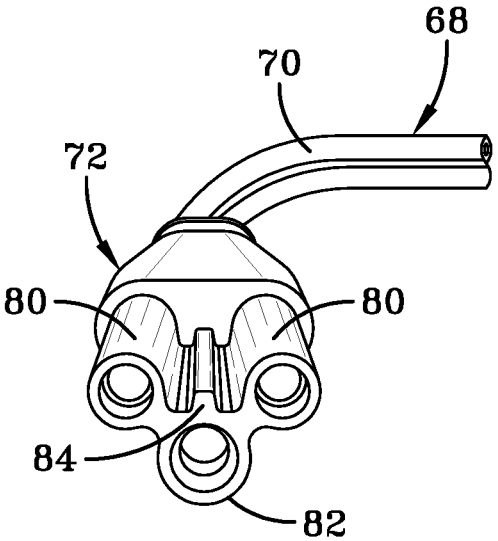
FIGS. 15A and 15B are perspective views of a power-in connector plug and a power-out connector plug as part of the aspect of the invention shown in FIG. 14 of the adjustable under cabinet light assembly according to a preferred embodiment of the invention.
Figure 15B:
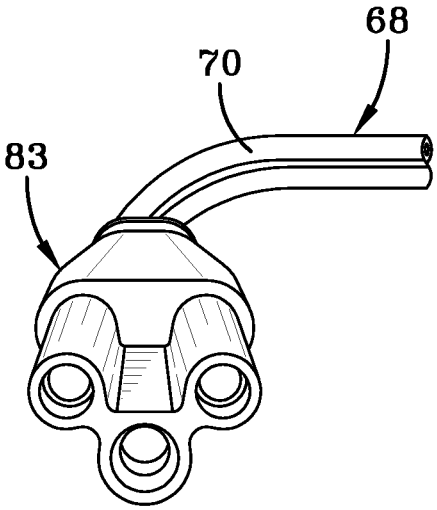

LED light tube fixtures 20 can be linked together so that they can be operated simultaneously. In order to do this, a linking cable 68 is used. Linking cables 68 is shown in FIGS. 14, 15A and 15B. Each linking cable 68 includes an electrical wire conductor 70 and a connector plugs 76 and 83 at opposite ends of a wire conductor 70.

The preferred embodiment of under cabinet LED light tube fixture 20 thus has a power-in end 76 for receiving an electricity transmitting line and a power-out end 78 for transmitting electricity from LED light tube fixture 20. Power out end 78 has a blocking portion discussed below. The device for linking LED light fixtures 20 must effect the transmission of electricity into power-in receptacle 8 and the transmission of electricity out of LED light tube fixture 20 through power-out receptacle 9. A power-in connector 72 shown in FIG. 15A has two identical upper tube structure 80 which are identical, a lower tube structure 82 whose inner and outer diameters are each larger than that of upper tube structures 80, and a small protrusion 84 extending between the upper tube structures 80. Power-out end 78 has a blocking portion such as a wall (not shown) which small protrusion 84 would have to abut to prevent power-in connector 72 from entering power-out receptacle 9. Thus protrusion 84 prevents the entrance of power-in connector 72 into power-out end 78 of LED light tube fixture 20. A power-out connector 83 is similar in size and dimensions to power-in connecting plug 72, but lacks any protrusion corresponding to protrusions 84 of power-in connector 72.

Figure 16:
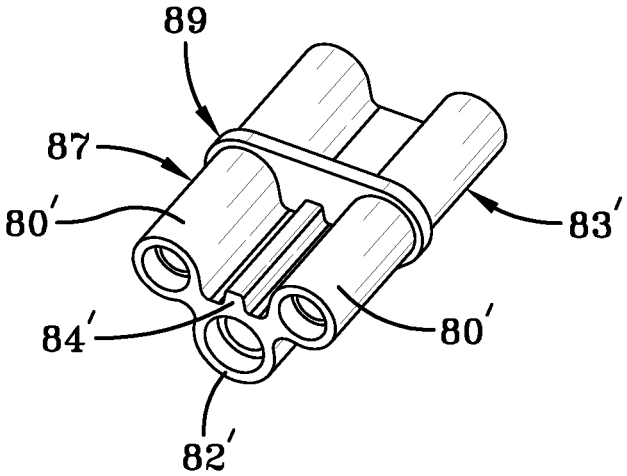
FIG. 16 is a perspective view of an end-to-end connector according to a preferred form of the invention.

Another way in which two LED light tube fixtures 20 can be electrically connected together is by means of an end-to-end connector 86. End-to-end connector 86 is shown in each of FIGS. 13 and 16. End-to-end connector 86 is composed of a set of three co-joined tubes, shown in FIG. 16. A power-in end 72' has axially extending parallel tubes 80', a single tube 82' and a protrusion 84' (corresponding to power-in connector 72 in FIG. 15A) for connection to the respective LED light tube fixtures 20 to render them actuable together. Power-out end 83' corresponds to power-out connector plug 83 with the latter's respective tubes.

A power cable 88 (FIG. 17) is provided for providing electrical power from a main power receptacle. Power cable 88 has a power plug 92 for insertion into an electric power receptacle, and power cable 88 includes a power-in connector 94 (corresponding to power-in connector 72) with three connected tubes having axial electrical connectors for transmitting power to an LED light tube fixture 20 from the main power receptacle into which plug 92 has been inserted.

LED light tube fixtures 20 can be actuated individually. As shown in FIG. 4, an electrical switch 16 is provided for each LED light tube fixture 20. Switch 16 is manually operable by means of a manual switch device 17 as appears in FIGS. 1A, 1B, 2A-2C and 3A-3C.

Another advantage of the present invention is the provision of plastic tube 15 (FIG. 4) which is manually adjustable and its interior component parts, and the moving device to be discussed below.

Figures 1A, 1B:
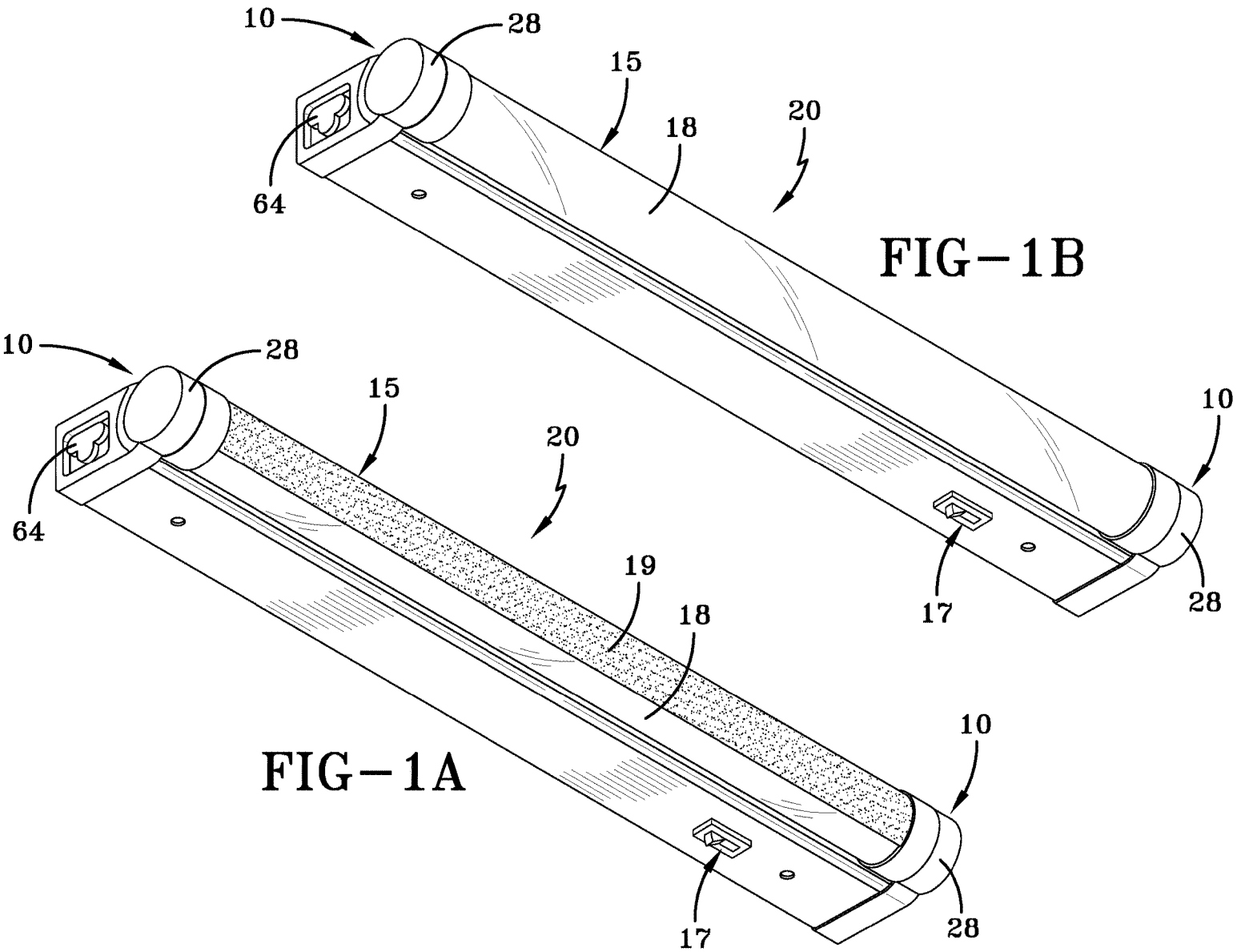
FIGS. 1A, 1B and 1C are perspective views of an adjustable under cabinet light assembly according to a preferred embodiment of the invention.
Figure 1C:
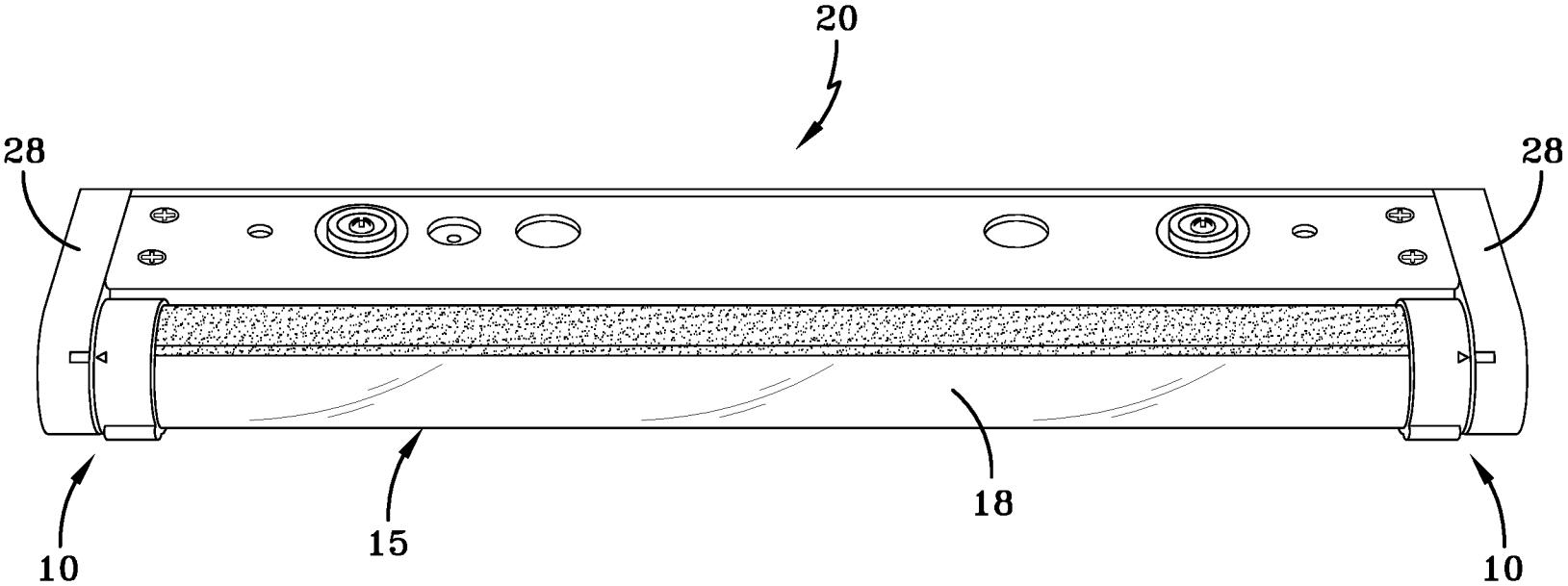
Figures 2A, 2B, 2C:
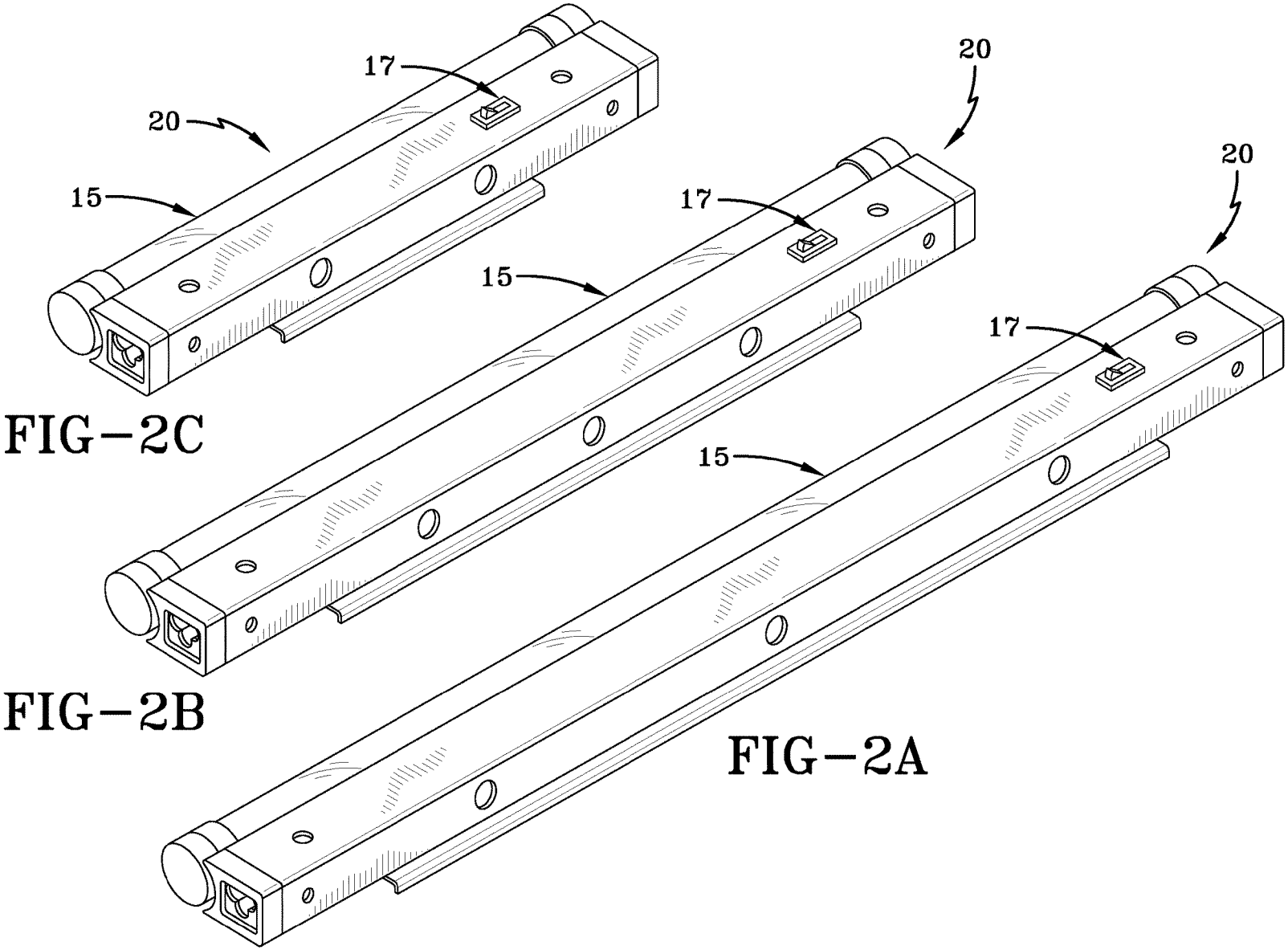
FIGS. 2A, 2B and 2C are perspective top views of three different sizes of the adjustable under cabinet light assembly shown in FIGS. 1A-1C.

As indicated in FIGS. 1A and 1B, LED light tube fixture 20 has multiple angular positions that can change the angle and coverage of illumination of fixture 20. Tube 15 is shown in FIGS. 1A-1C and 4, and brackets 6 and 7 in which tube rotates through the interconnection of cover 12, brackets 6 and 7 and grooved cylinders 50 and side covers 10. This renders the respective ends of tube 15 (with its contents) rotatable. FIGS. 6A-6E show the details of each cover 12. Cover 12 is fixed to plastic LED tube 15 and has fluted hub 62. Plastic tube 15 has an opaque portion 18 extending along its length, and a translucent portion 19 for transmitting light. Hubs 62 extend through groove cylinders 50 in each of left bracket 7 and right bracket 6. This enables the discrete rotation of plastic LED tube 15 to enable plastic LED tube 15 to be set at any one of the discrete angular relationships to direct illumination in a particular angle.

Another adjustment which can be made to the LED light tube fixture 20 is by means of the entire movement of LED light tube fixture 20. Provided on the top portion of LED light tube fixture 20 is backboard 4. As explained above, backboard 4 has two recesses 40 in which magnets 3 are inserted. Mounting plate 2 can be secured to an under cabinet such as from a cabinet hanging on a wall or to the ceiling portion of a cabinet beneath a sink, counter or other storage or working unit. In order to move LED light tube fixture 20 in virtually any direction along the planar interface of backboard 4 and mounted plate 2, LED light tube fixture 20 can be manually moved in any direction along the foregoing plane between backboard 4 and mounted plate 2. Following any such movement, LED light tube fixture 20 can be moved to its initial position, which normally would place backboard 48 in alignment with mounted plate 2.

Figure 17:
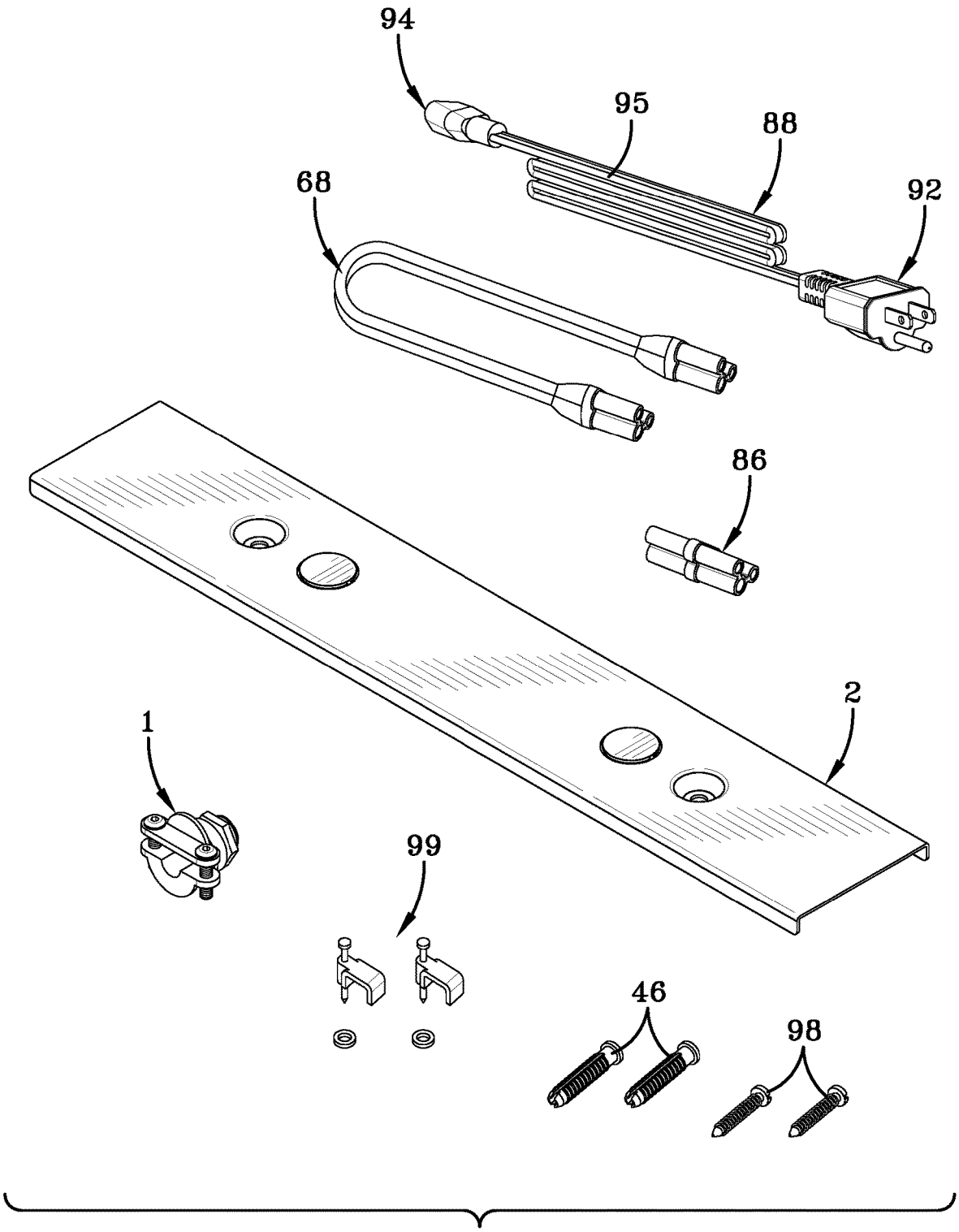
FIG. 17 shows in perspective various accessories for the preferred embodiment.

FIG. 17 shows various accessories for the adjustable under cabinet LED light fixture 20 described herein. Power cord assembly 88 was discussed above. Linking cable 68 is depicted, as is end-to-end connector 86. Mounting board 2 is shown. A pair of screws 98 for back board 4 are illustrated, as are wire clamps 99. UL connector 1 is depicted as well.

LED light tube fixture 20 is dimmable to change its color temperature. In the preferred embodiment of this aspect of the invention, dimming is in the range of 3000K to 2200K.

The foregoing invention has been described in detail with particular emphasis on its preferred embodiment. However, variations and details may occur to those skilled in the art from the invention set forth above and from the appended claims.

The invention claimed is:

1. An adjustable LED light assembly for controlling the direction of illumination from said adjustable LED light assembly, said adjustable LED light assembly comprising:

an elongated LED tube having a length and a longitudinal axis, and including:

a cylindrical exterior surface;

opposite open cylindrical ends;

a light transmitting longitudinal portion extending along the length of said cylindrical exterior surface; and an opaque section extending along a portion of said cylindrical exterior surface other than said light transmitting portion;

an elongated printed circuit board with an array of LEDs attached to said elongated printed circuit board, said elongated printed circuit board being located within and extending lengthwise within said elongated LED tube;

a pair of end covers mounted on the opposite open cylindrical ends of said elongated LED tube, each end cover comprising a cylindrical wall, each cylindrical wall being dimensioned to fit over said open cylindrical ends of said elongated LED tube, said end covers being rotatable with the rotation of said elongated LED tube, and each end cover comprising:

a fluted rotatable hub extending from said end cap along the longitudinal axis of said elongated tube in a direction opposite to said elongated LED tube;

an elongated LED tube-supporting bracket for supporting said elongated LED tube, said LED tube supporting bracket comprising:

a generally rectangular elongated base with opposite, parallel, elongated side edges and opposite end edges extending between said side edges;

a first sidewall extending in one direction from one elongated side edge of said generally rectangular elongated base; and a second sidewall extending opposite to and in the one direction of said first sidewall from an opposite edge of said generally rectangular base, said second sidewall being inwardly curved toward said first side and concentric with and partially surrounding said elongated LED tube when elongated LED tube is positioned along said second sidewall;

a pair of side covers, each side cover comprising:

a cup-like member for receiving one of said end covers; and a pair of end brackets for each of said pair of opposite ends of said elongated LED tube, each of said end brackets comprising:

an extension fixed to and extending between said tube-supporting bracket and a respective one of said pair of end covers, said extension comprising:

an interior grooved cylinder for receiving a respective one of said rotatable hubs extending from said end cover for enabling the rotation of said elongated LED tube and the rotation of said respective end covers, said interior grooved cylinder having grooves for receiving and cooperating with said fluted rotatable hub for enabling the stopping of the rotation of said LED tube to obtain a desired direction of illumination from said adjustable LED light assembly.

2. An adjustable LED light assembly comprising:

an LED tube supporting bracket including tube-supporting structure for enabling the rotation of an LED tube, said LED tube supporting bracket including a light transmitting opening;

a rotatable LED tube with a length, a longitudinal axis and including:

a cylindrical exterior surface including:

an opaque longitudinal section blocking the transmission of light from said LED tube therethrough;

a light transmitting longitudinal section; and opposite ends;

wherein said rotatable LED tube is mounted for rotation in said LED tube supporting bracket, and wherein said LED tube supporting bracket is concentric with and has a length substantially at least the same as the length of said rotatable LED tube;

an LED support assembly located within said LED tube supporting at least one LED for emitting light;

a pair of end covers dimensioned to fit on and close each of the opposite ends of said LED tube, each of said end covers comprising:

a hub extending outwardly from said rotatable LED tube and along the longitudinal axis of said rotatable LED tube, and flutes extending radially outwardly from said longitudinal axis;

a pair of end brackets fixed to and extending transversely from said respective ends of said LED tube holding bracket, each of said pair of end brackets including:

at least one end cover engaging component having a series of grooves for being sequentially engageable with said flutes on said hub of said respective pair of end covers for enabling the rotation of said rotatable LED tube; and wherein said rotatable LED tube is rotatable with said grooves in engagement with said flutes for enabling the rotation of said rotatable LED tube in a sequential manner, said grooves and said flutes cooperating to enable the stopping of the rotation of said LED tube and locate said opaque longitudinal section in a desired position to obtain the desired direction of illumination through said light transmitting opening.

3. An adjustable LED light assembly according to claim 2 wherein said LED tube supporting bracket comprises a curved wall concentric with said LED tube and having a radius of greater length than the radius of said LED tube; and wherein said light transmitting opening comprises:

a pair of opposing ends of said curved wall defining an opening through which opening light emitted by said rotatable LED tube is transmitted.

4. An adjustable LED light assembly comprising:

an LED tube assembly comprising:

an LED tube with a longitudinal LED tube axis, opposite LED tube ends and a length, said LED tube including:

an opaque portion extending along the length of said LED tube for a first longitudinal section of the longitudinal surface of said LED tube for preventing the transmission of LED light through said opaque portion;

a light transmitting portion extending along the length of said LED tube for a second longitudinal section from said first longitudinal section of said LED tube for transmitting light through said second longitudinal section; and an LED support extending along the longitudinal tube axis, said LED support supporting at least one LED mounted on said LED support for emitting light;

an LED tube assembly bracket with a length substantially the same as said LED tube, and including opposite ends and comprising:

a curved wall being concentric with and partially surrounding said LED tube, said curved wall having radius of greater length than the radius of said LED tube; and rotating structure for enabling the rotation of said LED tube relative to said LED assembly bracket, to locate said opaque portion in the path of light emitted by said at least one LED to control the visible light emitted by said at least one LED; wherein a LED tube end rotating structure is located at least one of said opposite LED tube ends for enabling the rotation of said LED tube about said longitudinal LED tube axis; wherein said LED tube end rotating structure comprises a selected one of a hub with radially extending flutes extending from said hub and an interiorly grooved cylinder mounted on at least one end of said LED tube and an end bracket fixed relative to said LED tube assembly bracket and the other of said interiorly grooved cylinder and said hub with said radially extending flutes mounted on the other of said end bracket fixed relative to said LED tube assembly bracket and said at least one end of said tube, to enable the emission of light from said from said LED tube in a selected direction according to the location of said opaque portion and said light transmitting portion of said LED tube.

5. An adjustable LED light assembly according to claim 4 and further comprising:

LED tube end supports for supporting each end of said LED tube end rotating structure, said LED tube end supports enabling the rotation of said LED tube about said longitudinal LED tube axis.

6. An adjustable LED light assembly according to claim 4 further comprising tube end covers for closing said LED tube, and respective turning structure for being engaged to effect the turning of said LED tube, and wherein:

said LED tube assembly bracket comprises:

an elongated base including a first linear elongated edge, said curved wall having opposite sides and being fixed to said first linear elongated edge, and extending partially over said elongated base, and wherein said LED tube is located on the opposite side of said curved wall from said base; and end brackets located at each of said opposite LED tube ends, each of said end brackets comprising:

a base attaching portion being fixed to said elongated base;

a turning portion for engaging said turning structure of said tube end covers; and an extension fixed both to said respective base attaching portion and to said respective turning portion.

7. An adjustable LED light assembly according to claim 6:

wherein said elongated base includes a second elongated edge parallel to said first elongated edge; and wherein said LED tube assembly further comprises a sidewall extending from said second elongated edge in the same direction as said curved wall;

wherein each of said elongated base, said curved wall and said sidewall have the same opposite first and second ends; and wherein said adjustable LED light assembly further includes electrical component cavities housing electrical components for transmitting or receiving electricity to and from respectively said respective at least one LED, said cavities being located at said opposite first and second ends defined between said curved portion and said second wall of said base; and wherein said extension of said end brackets is traverse to said elongated base, and wherein said end brackets further comprise:

respective generally flat sections extending transversely to said respective extensions and between said curved portion and said second sidewall; and wherein said respective extensions further comprises walls defining a selected one of orifices for receiving a power-in receptacle and a power-out receptacle, respectively, to enable the transmission of electrical power to and from said electrical components.

8. An adjustable LED light assembly according to claim 4:

wherein said elongated base further includes a second linear elongated edge parallel to said first linear elongated edge; and wherein said LED tube assembly comprises a sidewall extending from said second elongated edge;

wherein said curved wall and said side wall each have top edges on the opposite part of said curved wall portion fixed to said first elongated edge and said sidewall fixed to said second elongated edge; and wherein said adjustable LED light assembly further comprises:

a backboard secured said top edges of said curved wall and said side wall; and a mounting plate for being secured to an overhanging wall;

at least one of said backboard and said mounting plate being at least partially ferromagnetic, and the other of said backboard and said mounting plate comprising at least one magnet mounted thereon for securing said adjustable LED light assembly to said overhanging wall, and enabling movement of said adjustable LED light assembly relative to said overhanging wall.

* * * * *